US007743879B2

(12) United States Patent
Inagaki et al.

(10) Patent No.: US 7,743,879 B2
(45) Date of Patent: Jun. 29, 2010

(54) DIAPHRAGM, SPHERICAL-SHELL DIAPHRAGM AND ELECTROACOUSTIC TRANSDUCER, AND METHOD OF MANUFACTURING ELECTROACOUSTIC TRANSDUCER

(75) Inventors: Kazuyuki Inagaki, Yokohama (JP); Jiro Nakaso, Yokohama (JP); Manabu Omoda, Yokohama (JP)

(73) Assignee: Victor Company of Japan, Limited, Yokohama (JP)

( * ) Notice: Subject to any disclaimer, the term of this patent is extended or adjusted under 35 U.S.C. 154(b) by 0 days.

(21) Appl. No.: 12/232,206

(22) Filed: Sep. 12, 2008

(65) Prior Publication Data

US 2009/0014233 A1 Jan. 15, 2009

Related U.S. Application Data

(62) Division of application No. 11/332,488, filed on Jan. 17, 2006, now Pat. No. 7,438,156.

(30) Foreign Application Priority Data

| | | |
|---|---|---|
| Jan. 20, 2005 | (JP) | P2005-013378 |
| Jan. 20, 2005 | (JP) | P2005-013380 |
| Jan. 20, 2005 | (JP) | P2005-013383 |
| Dec. 28, 2005 | (JP) | P2005-378001 |

(51) Int. Cl.
*H04R 7/14* (2006.01)

(52) U.S. Cl. ..... 181/173; 181/164; 381/423

(58) Field of Classification Search ..... 181/153, 181/164, 165, 173; 381/423
See application file for complete search history.

(56) References Cited

U.S. PATENT DOCUMENTS

| | | | | |
|---|---|---|---|---|
| 1,748,990 A | | 3/1930 | Nilson | |
| 1,859,629 A | | 5/1932 | Nilson | |
| 3,940,576 A | | 2/1976 | Schultz | |
| 4,673,057 A | * | 6/1987 | Glassco | 181/144 |
| 5,025,473 A | * | 6/1991 | Carlsen et al. | 381/387 |

(Continued)

FOREIGN PATENT DOCUMENTS

| | | |
|---|---|---|
| JP | 182386 | 11/1949 |

(Continued)

*Primary Examiner*—Jeffrey Donels
*Assistant Examiner*—Jeremy Luks
(74) *Attorney, Agent, or Firm*—The Nath Law Group; Jerald L. Meyer; Stanley N. Protigal

(57) ABSTRACT

A diaphragm in one mode of the present invention comprises an outer shape section having a circle with one diameter, or a shape of a polygon to be inscribed in a circle with the one diameter; an inner shape section protruding in one direction with regard to a plane including the outer shape section, wherein a shape formed by projecting the inner shape section on the plane is rotationally symmetric about the central axis of the circle; and a vibrating face section linking the outer shape section and the inner shape section and having an inclined face inclined to the central axis, wherein any one of cross-sectional shapes of the vibrating face section is rotationally symmetric about an eccentric axis which is eccentric with regard to the central axis, the cross-sectional shapes being defined by a plane intersecting perpendicularly to the central axis. An electroacoustic transducer uses the above diaphragm.

19 Claims, 17 Drawing Sheets

U.S. PATENT DOCUMENTS

| | | | | |
|---|---|---|---|---|
| 5,812,685 | A * | 9/1998 | Fujita et al. | 381/332 |
| 6,009,972 | A * | 1/2000 | Choi et al. | 181/155 |
| 6,961,438 | B1 * | 11/2005 | Fujita | 381/182 |
| 2004/0170282 | A1 * | 9/2004 | Tahara et al. | 381/58 |

FOREIGN PATENT DOCUMENTS

| | | | |
|---|---|---|---|
| JP | 54-079621 | A | 6/1979 |
| JP | 59-31105 | Y2 | 9/1984 |
| JP | 09-284886 | | 10/1997 |
| JP | 10-341493 | A | 12/1998 |
| JP | 2000-078686 | | 3/2000 |
| JP | 2001-095088 | | 4/2001 |
| JP | 2004297148 | A * | 10/2004 |

* cited by examiner

DIAPHRAGM, SPHERICAL-SHELL DIAPHRAGM AND ELECTROACOUSTIC TRANSDUCER, AND METHOD OF MANUFACTURING ELECTROACOUSTIC TRANSDUCER

BACKGROUND OF THE INVENTION

1. Technical Field

The present invention relates to a diaphragm, a spherical-shell diaphragm and an electroacoustic transducer, and a method of manufacturing an electroacoustic transducer.

2. Description of the Related Art

An electroacoustic transducer, which is provided with a diaphragm, a frame supporting the periphery of the diaphragm, and a driving section with a magnetic circuit which vibrates the diaphragm in a uniaxial direction, and emits a sound, has been generally called a speaker. Such a diaphragm has had quite often a shape of a cone.

Generally, the surface profile of this cone shape is a nearly circular truncated cone, wherein the cone is obtained by cutting off the top portion of a nearly circular cone (right circular cone) with rotational symmetry about a central axis, and has inner and outer peripheries and an inclined portion inclined to the central axis which is in the vibrating direction.

Incidentally, it has been known that, in the case of the diaphragm with a shape of the nearly circular truncated cone, standing waves are generated in the radius direction all around the diaphragm, and there are easily caused a peak and a dip in frequency-sound pressure characteristics.

Then, in order to hinder such a peak and dip from being caused, there has been proposed a circular truncated cone that is configured in a way that the central axis of the inner periphery is eccentric from that of the outer one.

In the truncated circular cone having such eccentricity, a distance between the inner periphery end and the outer periphery end, the distance being measured along a line passing through the center axis of the inner periphery, is not constant along their circumferential direction.

Accordingly, the wavelength of a standing wave generated in the diaphragm is changed according to the circumferential positions, and a peak and a dip in the frequency-sound pressure characteristics are smoothened out.

As described above, the diaphragm with eccentricity may control the generation of a peak and a dip in the frequency-sound pressure characteristics. However, it is somewhat disadvantageous in that a general-purpose frame or a component for a magnetic circuit cannot be used for such a diaphragm, because such a frame or a component has an outer shape that is not eccentric with regard to the central axis of the inner periphery.

Thereupon, a structure without the above-described disadvantage has been described in Japanese Patent Application Laid-Open Publication No. H09-284886. According to this structure, the above-described diaphragm with eccentricity is installed in a frame or a component for a magnetic circuit, the outer shape of the component or the frame being not eccentric.

On the other hand, there has been known an electroacoustic transducer, which is provided with a diaphragm with a nearly spherical shape, and one driving section (magnetic circuit section) vibrating the diaphragm in the radial direction, and emits a sound in all directions from the center of the diaphragm.

This electroacoustic transducer is called a spherical speaker, a pulsating sphere speaker, or the like, and, has been disclosed in, for example, Japanese Patent Application Laid-Open Publications Nos. 2000-78686, and 2001-95088.

These publications have described, as one example of the diaphragm of this electroacoustic transducer, a diaphragm obtained by combining a plurality of diaphragms with a predetermined shape of approximately a plane into a shape of a nearly sphere.

Incidentally, Japanese Patent Application Laid-Open Publication No. H09-284886 has disclosed that a speaker having an edge member to be connected with the outer periphery of the diaphragm, the edge member having different widths in the radial direction, and a speaker having an edge member and a diaphragm installing member, wherein the edge member has a constant width in the radial direction where as the diaphragm installing member connecting the above edge member and a frame has different widths in the radial direction, in order to install the diaphragm of which outer shape is eccentric with regard to the center in a frame in which a magnetic circuit is fixed at the center.

However, the above-described configurations have had a problem that, since neither the edge portion nor the diaphragm installing member are a diaphragm, and contribute to radiation of a voice, the projected area of the diaphragm becomes small to the size of the outer shape of the frame, and it is difficult, considering the size of the frame, to obtain a high sound-pressure in a range of low-pitched sound, and also to perform electroacoustic conversion of an input signal with a high efficiency.

Moreover, there has been a problem that, since the outer shape of the diaphragm is eccentric to the center of the magnetic circuit, the radiating axis of a voice does not intersect perpendicularly to the installed surface of the speaker, and it is difficult to specify a reference direction for a radiated voice and also to have a uniform directivity in the circumferential direction.

SUMMARY OF THE INVENTION

Then, the present invention has been made in order to solve the above-described problems, and its object is to provide a diaphragm and an electroacoustic transducer that are capable of reducing generation of standing waves, obtaining a high sound-pressure even in a range of low-pitched sound, realizing highly efficient electroacoustic conversion of an input signal, specifying a reference direction for a radiated voice, and obtaining a uniform directivity in the circumferential direction.

Moreover, another object thereof is to provide a spherical shell diaphragm and an electroacoustic transducer that are capable of reducing generation of standing waves, reducing the number of peaks and dips, even if the diaphragm has a shape of a nearly spherical shell; unneccesitating a special bonding member; positioning easily in assembling; realizing especially high sound pressure even in a range of low-pitched sounds; and realizing a highly efficient electro-acoustic conversion of input signals.

Furthermore, yet another object is to provide a method of manufacturing an electroacoustic transducer configured by joining a plurality of polygonal segments with an elastic material to produce a polyhedron spherical shell diaphragm, the respective polygonal segment being to be driven by an individual driving section, the method being able to facilitate positioning of each section so that easy assembling is realized and to reduce characteristics variation.

In order to realize the above-described objects, the present invention has the following configurations [1] through [6] as a solution.

[1] A diaphragm (10, 10R), comprising an outer shape section (14) with a shape of a circle having one diameter (D2), or a shape of a polygon which is inscribed in a circle with the one diameter (D2); an inner shape section (13) which protrudes in one direction with regard to a plane (PO) including the outer shape section (14), wherein a shape formed by projecting the inner shape section (13) on the plane (PO) is rotationally symmetric about the central axis (O) of the circle with the one diameter (D2); and a vibrating face section (12) that links the outer shape section (14) and the inner shape section (13) and has an inclined face inclined to the central axis (O), wherein any one of cross-sectional shapes of the vibrating face section (12) is rotationally symmetric about an eccentric axis (O2) which is eccentric with regard to the central axis (O), the cross-sectional shapes being defined by a plane (SS) intersecting perpendicularly to the central axis (O).

[2] A diaphragm (10, 10R), comprising an outer shape section (14) with a shape of a circle having one diameter (D2), or a shape of a polygon which is inscribed in a circle with the one diameter (D2); an inner shape section (13) which protrudes in one direction with regard to a plane (PO) including the outer shape section (14), wherein a shape formed by projecting the inner shape section (13) on the plane (PO) is rotationally symmetric about the central axis (O) of the circle with the one diameter (D2); and a vibrating face section (12) that links the outer shape section (14) and the inner shape section (13) and has an inclined face inclined to the central axis (O), wherein the vibrating face section (12) includes a rotationally symmetric orbiting line (15) about an eccentric axis (O2) which is eccentric with regard to the central axis (O); and a curvature (R) of or an inclination angle of the vibrating face (12*a*) inside of the orbiting line (15) and a curvature (R) of or an inclination angle of the vibrating face (12*b*) outside of the orbiting line (15) are discontinuous at the orbiting line (15), the orbiting line (15) being sandwiched between the both faces (12*a*, 12*b*).

[3] A diaphragm (100), comprising an outer shape section (14) with a regular n-gonal shape (n: an integer of 4 or more) which is inscribed in a circle with one diameter (D2); and n number of top portions (TP1 through TPn) that are provided respectively within n number of triangles (TR1 through TRn) obtained by dividing the regular n-gonal shape with line segments (T1G through TnG) connecting the center (GO) of the regular n-gonal shape and the vertices (T1 through Tn) of the regular n-gonal shape, wherein each line segment obtained by connecting the top portions (TP1 through TPn) with vertices (T1 through Tn) and the center (GO) is formed to be a ridge line; wherein the n-number of top portions (TP1 through TPn) are on an outer periphery line (C2) which is rotationally symmetric about an eccentric axis (O3) which is eccentric with regard to the central axis (GO) of the regular n-gonal shape.

[4] The diaphragm (100) according to the present invention, wherein the n-number of top portions (TP1 through TPn) and the center (GO) of the regular n-gonal shape are positioned so as to be protruded in one direction with regard to a plane (PO) including the vertices (T1 through Tn).

[5] The diaphragm (100) according to the present invention, wherein the center (GO) of and the vertices (T1 through Tn) of the regular n-gonal shape, and the n-number of top portions (TP1 through TPn) are on the same spherical surface (CF).

[6] An electroacoustic transducer (50, 50A), comprising the diaphragm (10, 10R, 100) according to the present invention; a flexible connecting member (30) connected with the outer shape section (14) of the diaphragm (10, 10R, 100); a frame (31) supporting the diaphragm (10, 10R, 100) through the connecting member (30) in such a way that the diaphragm (10, 10R, 100) is freely vibrated; and a driving section (32) which has a voice coil bobbin (21) linked to one surface of the inner shape section (13) in the diaphragm, and vibrates the diaphragm (10, 10R, 100).

[7] An electroacoustic transducer (50, 50A), comprising the diaphragm (10, 10R, 100) according to the present invention; a flexible connecting member (30) connected with the outer shape section (14) of the diaphragm (10, 10R, 100); a frame (31) supporting the diaphragm (10, 10R, 100) through the connecting member (30) in such a way that the diaphragm (10, 10R, 100) is freely vibrated; and a driving section (32) which has a voice coil bobbin (21) linked to one surface of the inner shape section (13) in the diaphragm (10, 10R, 100), and vibrates the diaphragm (10, 10R, 100).

[8] An electroacoustic transducer (50, 50A), comprising the diaphragm (10, 10R, 100) according to the present invention; a flexible connecting member (30) connected with the outer shape section (14) of the diaphragm (10, 10R, 100); a frame (31) supporting the diaphragm (10, 10R, 100) through the connecting member (30) in such a way that the diaphragm (10, 10R, 100) is freely vibrated; and a driving section (32) which has a voice coil bobbin (21) linked to one surface of the inner shape section (13) in the diaphragm (10, 10R, 100), and vibrates the diaphragm (10, 10R, 100).

[9] A spherical shell diaphragm (200), comprising a plurality of diaphragms (10, 10R) with a regular n-gonal shape (n: an integer of 4 or more) which is inscribed in a circle with one diameter (D2), the plurality of diaphragms (10, 10R) being formed into a nearly spherical shape by linking together outer shape sections (14) of the plurality of diaphragms (10, 10R), wherein each of the plurality of diaphragms (10, 10R) includes; an inner shape section (13) which protrudes in an outer direction with regard to a plane (PO) including an outer shape section (14) of the diaphragm (10, 10R), wherein a shape formed by projecting the inner shape section (13) on the plane (PO) is rotationally symmetric about the central axis (O) of the circle with the one diameter (D2); and a vibrating face section (12) that links the outer shape section (14) and the inner shape section (13) and has an inclined face inclined to the central axis (O), wherein any one of cross-sectional shapes of the vibrating face section (12) is rotationally symmetric about an eccentric axis (O2) which is eccentric with regard to the central axis (O), the cross-sectional shapes being defined by a plane (SS) intersecting perpendicularly to the central axis (O).

[10] The spherical shell diaphragm (200, 201) according to the present invention, wherein the outer shape sections (14) of the plurality of diaphragms (10, 10R, 100) are connected with one another through flexible linking members (102).

[11] The spherical shell diaphragm (200, 201) according to the present invention, wherein the nearly spherical shell shape is a regular dodecahedron.

[12] The spherical shell diaphragm (200, 201) according to the present invention, wherein when there is set a dividing line (EQ) that separates the spherical shell diaphragm into two portions along outer shape sections (14) in such a way that each of said two portions has the same number of the diaphragms (10, 10R, 100) having an outer shape section (14) along the dividing line (EQ), the eccentric axis (O3) of the diaphragm (10, 10R, 100) having the outer shape section (14) along the dividing line (EQ) is eccentric in a direction toward the vertex of the outer shape section (14) along the dividing line (EQ).

[13] The spherical shell diaphragm (200, 201) according to the present invention, wherein any one of the plurality of diaphragms (10, 10R, 100) has an opening.

[14] A spherical shell diaphragm (200), comprising a plurality of diaphragms (10, 10R) having a regular n-gonal shape (n: an integer of 4 or more) which is inscribed in a circle with one diameter (D2), the plurality of diaphragms (10, 10R) being formed into a nearly spherical shape by linking together outer shape sections (14) of the plurality of diaphragms (10, 10R), wherein each of the plurality of diaphragms (10, 10R) includes; an inner shape section (13) which protrudes in an outer direction with regard to a plane (PO) including an outer shape section (14) of the diaphragm, wherein a shape formed by projecting the inner shape section (13) on the plane (PO) is rotationally symmetric about the central axis (O) of the circle with the one diameter (D2); and a vibrating face section (12) that links the outer shape section (14) and the inner shape section (13) and has an inclined face inclined to the central axis (O), wherein the vibrating face section (12) includes a rotationally symmetric orbiting line (15) about an eccentric axis (O2) which is eccentric with regard to the central axis (O); and a curvature (R) of or an inclination angle of the vibrating face (12*a*) inside of the orbiting line (15) and a curvature (R) of or an inclination angle of the vibrating face (12*b*) outside of the orbiting line (15) are discontinuous at the orbiting line (15).

[15] The spherical shell diaphragm (200, 201) according to the present invention, wherein the outer shape sections (14) of the plurality of diaphragms (10, 10R, 100) are connected with one another through flexible linking members (102).

[16] The spherical shell diaphragm (200, 201) according to the present invention, wherein the nearly spherical shell shape is a regular dodecahedron.

[17] The spherical shell diaphragm (200, 201) according to the present invention, wherein when there is set a dividing line (EQ) separates the spherical shell diaphragm into two portions along the outer shape sections (14) in such a way that each of the two portions has the same number of the diaphragms (10, 10R, 100) having an outer shape section (14) along the dividing line (EQ), the eccentric axis of the diaphragm (10, 10R, 100) having an outer shape section (14) along the dividing line (EQ) is eccentric in a direction toward the vertex of the outer shape section (14) along the dividing line (EQ).

[18] The spherical shell diaphragm (200, 201) according to the present invention, wherein any one of the plurality of diaphragms (10, 10R, 100) has an opening.

[19] A spherical shell diaphragm (201), comprising a plurality of diaphragms (100) with a regular n-gonal shape (n: an integer of 4 or more) which is inscribed in a circle with one diameter (D2), the plurality of diaphragms (100) being formed into a nearly spherical shape by linking together outer shape sections (14) of the plurality of diaphragms (100), wherein each of the plurality of diaphragms (100) includes; n number of top portions (TP1 through TPn) that are provided respectively within n number of triangles (TR1 through TRn) obtained by dividing the regular n-gonal shape with line segments (T1G through TnG) connecting the center (GO) of the regular n-gonal shape and the vertices (T1 through Tn) of the regular n-gonal shape, wherein each line segment obtained by connecting the top portions (TP1 through TPn) with vertices (T1 through Tn) and the center (GO) is formed to be a ridge line; wherein the n-number of top portions (TP1 through TPn) are on an outer periphery line (C2) of a shape with rotational symmetry about the central axis (GO) of the regular n-gonal shape.

[20] The spherical shell diaphragm (201) according to the present invention, wherein the shape with rotational symmetry is rotationally symmetric about an eccentric axis (O3) which is eccentric with regard to the central axis (GO).

[21] The spherical shell diaphragm (201) according to the present invention, wherein, in the diaphragms (100), the n-number of top portions (TP1 through TPn) and the center (GO) of the regular n-gonal shape are positioned so as to be protruded into one direction with regard to a plane (PO) including the vertices (T1 through Tn).

[22] The spherical shell diaphragm (201) according to the present invention, wherein in each of the diaphragms (100), n-number of vertices (T1 through Tn) as vertices of the regular n-gonal shape in the outer shape section (14), the n-number of top portions (TP1 through TPn), and the center (GO) of the regular n-gonal shape are on the same spherical surface (CF).

[23] The spherical shell diaphragm (201) according to the present invention, wherein the spherical shell diaphragm (201) include a plurality of diaphragms (100) with the same spherical surface (CF) as one another.

[24] The spherical shell diaphragm (200, 201) according to the present invention, wherein the outer shape sections (14) of the plurality of diaphragms (10, 10R, 100) are connected with one another through flexible linking members (102).

[25] The spherical shell diaphragm (200, 201) according to the present invention, wherein the nearly spherical shell shape is a regular dodecahedron.

[26] The spherical shell diaphragm (200, 201) according to the present invention, wherein when there is set a dividing line (EQ) separates the spherical shell diaphragm into two portions along the outer shape sections (14) in such a way that each of the two portions has the same number of the diaphragms (10, 10R, 100) having an outer shape section (14) along the dividing line (EQ), the eccentric axis (O3) of the diaphragm (10, 10R, 100) having an outer shape section (14) along the dividing line (EQ) is eccentric in a direction toward the vertex of the outer shape section along the dividing line (EQ).

[27] The spherical shell diaphragm (200, 201) according to the present invention, wherein any one of the plurality of diaphragms (10, 10R, 100) has an opening.

[28] An electroacoustic transducer (150) using the spherical shell diaphragm (200, 201) according to the present invention.

[29] The electroacoustic transducer (150) according to the present invention, further comprising a plurality of voice coil bobbins (221) connected respectively with the inside surfaces of the plurality of diaphragms (10, 10R, 100); and a plurality of driving sections (232) which respectively include one of the voice coil bobbins (221), and vibrate the plurality of diaphragms (10, 10R, 100).

[30] An electroacoustic transducer (150) using the spherical shell diaphragm according to the present invention, wherein the plurality of diaphragms (10, 10R, 100) are linked together in such a way that the plurality of diaphragms (10, 10R, 100) form eleven surfaces of the regular dodecahedron.

[31] The electroacoustic transducer (150) according to the present invention, comprising a plurality of voice coil bobbins (221) connected respectively with the inside surfaces of the plurality of diaphragms (10, 10R, 100); and a plurality of driving sections (232) which respectively include one of the voice coil bobbins (221), and vibrate the plurality of diaphragms (10, 10R, 100), respectively.

[32] An electroacoustic transducer (150) using the spherical shell diaphragm (200, 201) according to the present invention.

[33] The electroacoustic transducer (150) according to the present invention, comprising a plurality of voice coil bobbins (221) connected with the inside surfaces of the plurality of diaphragms (10, 10R, 100), respectively; and a plurality of driving sections (232) which respectively include one of the voice coil bobbins (221), and vibrate the plurality of diaphragms (10, 10R, 100), respectively.

[34] An electroacoustic transducer (150) using the spherical shell diaphragm (200, 201) according to the present invention, wherein the plurality of diaphragms (10, 10R, 100) are linked together in such a way that the plurality of diaphragms (10, 10R, 100) form eleven surfaces of the regular dodecahedron.

[35] The electroacoustic transducer (150) according to the present invention, comprising a plurality of voice coil bobbins (221) connected respectively with the inside surfaces of the plurality of diaphragms (10, 10R, 100); and a plurality of driving sections (232) which respectively include one of the voice coil bobbins (221), and vibrate the plurality of diaphragms (10, 10R, 100), respectively.

[36] An electroacoustic transducer (150) using the spherical shell diaphragm (200, 201) according to the present invention.

[37] The electroacoustic transducer (150) according to the present invention, comprising a plurality of voice coil bobbins (221) connected respectively with the inside surfaces of the plurality of diaphragms (10, 10R, 100); and a plurality of driving sections (232) which respectively include one of the voice coil bobbins (221), and vibrate the plurality of diaphragms (10, 10R, 100), respectively.

[38] An electroacoustic transducer (150) using the spherical shell diaphragm (200, 201) according to the present invention, wherein the plurality of diaphragms (10, 10R, 100) are linked together in such a way that the plurality of diaphragms (10, 10R, 100) form eleven surfaces of the regular dodecahedron.

[39] The electroacoustic transducer (150) according to the present invention, comprising a plurality of voice coil bobbins (221) connected respectively with the inside surfaces of the plurality of diaphragms (10, 10R, 100); and a plurality of driving sections (232) which respectively include one of the voice coil bobbin (221), and vibrate the plurality of diaphragms (10, 10R, 100), respectively.

[40] A method of manufacturing an electroacoustic transducer (150), comprising making, from a diaphragm material, a diaphragm segment (10, 10R, 100, 101) with an outer shape section (14) having a shape of a regular pentagon which is inscribed in a circle with one diameter (D2); arranging a plurality of the diaphragm segments (10, 10R, 100, 101) in plane, to bond, with an flexible linking member (102), sides which can be arranged in parallel with one another so as to oppose one another by positioning the vertices thereof; fastening a plurality of driving sections (232) which respectively have a voice coil bobbin (221), and vibrate the plurality of diaphragm segments (10, 10R, 100, 101), respectively, to each surface (132*a*) of a base (130) with an outer shape of a regular dodecahedron in such a way that each of the voice coil bobbins (221) extends in a direction intersecting perpendicularly to each of the surfaces (132*a*) of the regular dodecahedron; and fastening the plurality of voice coil bobbins (221) to the inside surfaces of the plurality of diaphragm segments (10, 10R, 100, 101), respectively.

[41] The method of manufacturing an electroacoustic transducer (150), according to the present invention, wherein the plurality of diaphragm segments (10, 10R, 101) comprise: an inner shape section (13) which protrudes in one direction with regard to a plane (PO) including the outer shape section (14), wherein a shape formed by projecting the inner shape section (13) on the plane (PO) is rotationally symmetric about the central axis (O) of the circle with the one diameter (D2); and a vibrating face section (12) that links the outer shape section (14) and the inner shape section (13) and has an inclined face inclined to the central axis (O), wherein any one of cross-sectional shapes of the vibrating face section (12) is rotationally symmetric about an eccentric axis (O2) which is eccentric with regard to the central axis (O), the cross-sectional shapes being defined by a plane (SS) intersecting perpendicularly to the central axis (O).

[42] The method of manufacturing an electroacoustic transducer (150), according to the present invention, wherein each of the plurality of diaphragm segments (100, 101) comprises: an outer shape section (14) with a regular n-gonal shape (n: an integer of 4 or more) which is inscribed in a circle with one diameter (D2), n-number of top portions (TP1 through TPn) that are provided respectively within n number of triangles (TR1 through TRn) obtained by dividing the regular n-gonal shape with line segments (T1G through TnG) connecting the center (GO) of the regular n-gonal shape and the vertices (T1 through Tn) of the regular n-gonal shape, wherein each line segment obtained by connecting the top portions (TP1 through TPn) with vertices (T1 through Tn) and the center (GO) is formed to be a ridge line; and the n-number of top portions (TP1 through TPn) are on an outer periphery line (C2) of a shape with rotational symmetry about an eccentric axis (G3) which is eccentric with regard to the central axis (GO) of the regular n-gonal shape.

According to the present invention, there may be provided an advantage that generation of standing waves is reduced, a high sound-pressure is obtained even in a range of low-pitched sound, a highly-efficient electroacoustic conversion of an input signal is enabled, a reference direction for a voice radiation is specified, and a uniform directivity in the circumferential direction is obtained.

According to the present invention, there may be brought about another advantage that generation of standing waves is reduced; a special bonding member is not required; positioning is easy upon assembling; high sound pressure may be obtained even in a range of low-pitched sounds; and a highly efficient electro-acoustic conversion of input signals may be enabled.

According to the present invention, there may be presented yet another advantage of simplified positioning of each section, easy assembling, and reduced variations in sound characteristics.

BRIEF DESCRIPTION OF THE DRAWINGS

FIGS. 11A and 11B are comparative illustration, wherein FIG. 11A is a front view explaining a conventional diaphragm and FIG. 11B is a front view explaining a diaphragm according to a second example of the present invention;

DESCRIPTION OF THE PREFERRED EMBODIMENTS

Referring to preferred examples, an embodiment according to the present invention will be explained, using FIG. 1 through FIG. 19.

In the following explanations, the rotational symmetry means at least twofold or more rotational symmetry.

FIRST EXAMPLE

Figure 1:
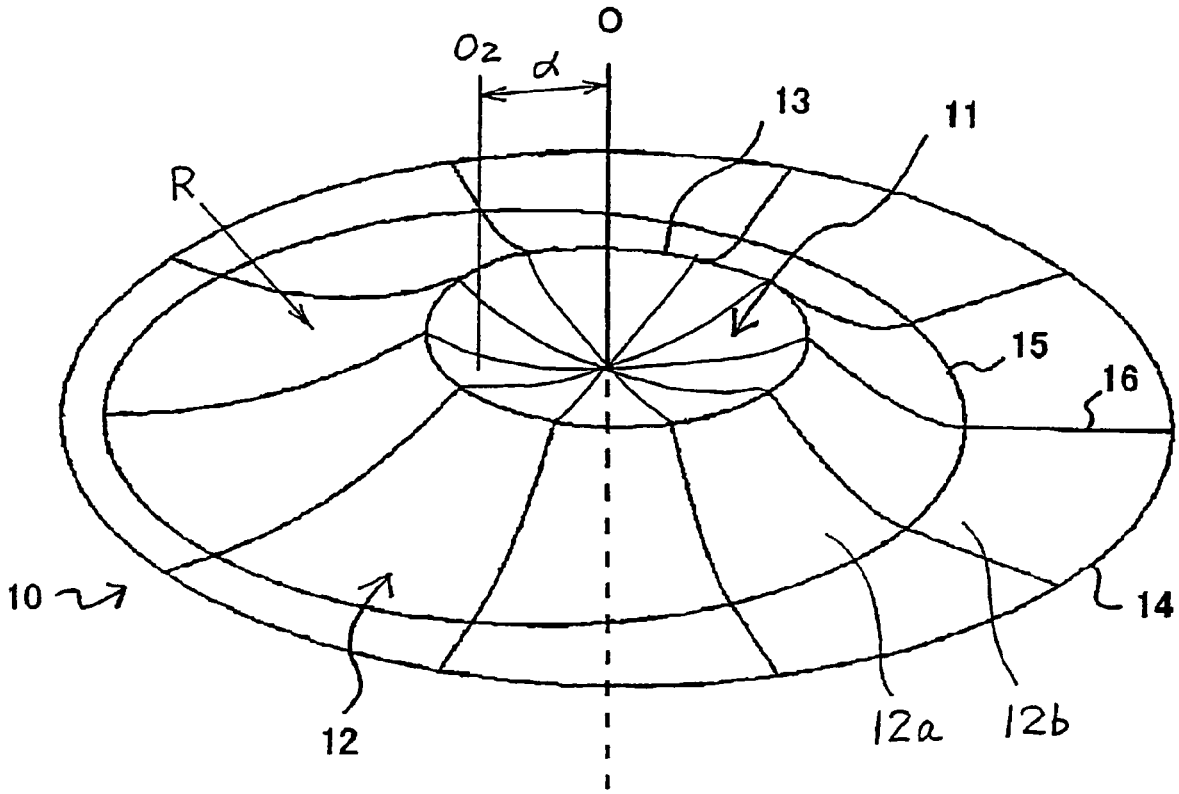
FIG. 1 is a schematic perspective view showing a diaphragm according to a first example of the present invention.

The shape of a diaphragm according to a first example will be explained using FIGS. 1, 2A and 2B. In FIG. 1, a curvature of the curved surface of a diaphragm 10 is schematically shown with a plurality of solid lines 16 in the radial direction for the sake of easier understanding.

FIG. 1 is a perspective view showing an external appearance of the diaphragm 10; FIG. 2A is a plan view showing the diaphragm 10; and FIG. 2B is a sectional view taken along the S1-S1 line in FIG. 2A.

Figures 2A, 2B:
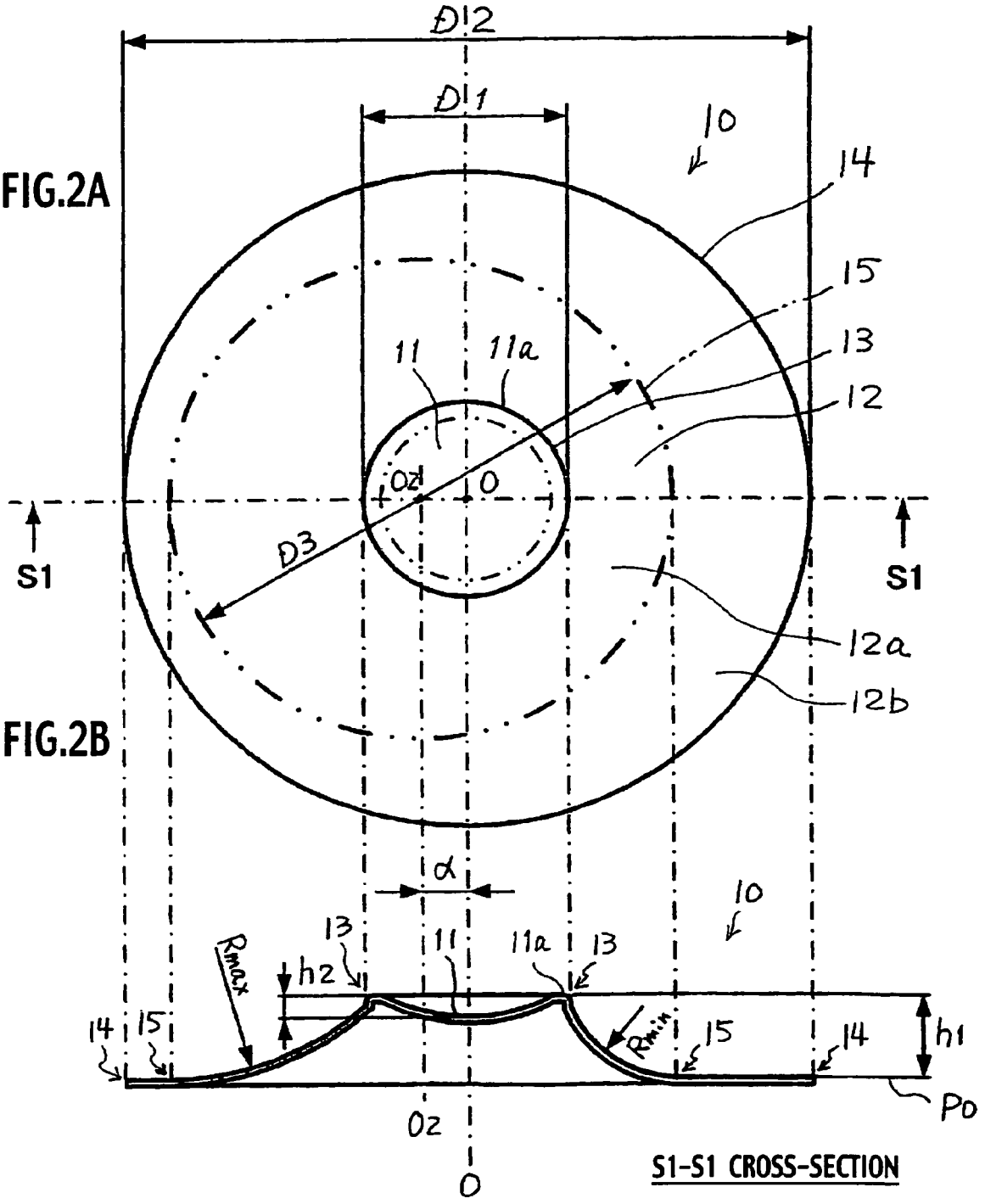
FIG. 2A is a plan view showing the diaphragm according to the first example of the present invention.
FIG. 2B is a cross-sectional view showing the diaphragm according to the first example of the present invention.

As shown in FIGS. 1, 2A, and 2B, the diaphragm 10 is formed like a nearly disc which includes a center section 11 ranging from a central axis O to an inner diameter section 13 with a diameter D1 [refer to FIG. 2A], and an inclined section 12 ranging from the inner section 13 to an outer diameter section 14 with a diameter D2 [refer to FIG. 2A].

The material of the diaphragm is not limited to a special one, but a sheet of paper, resin such as polypropylene (PP), metal such as aluminum, ceramics, or wood may be used.

The inner diameter section 13 is formed, protruding from a reference surface PO including the outer diameter section 14 by a maximum height h1 [refer to FIG. 2B], and the center section 11 within the inside of the inner diameter section 13 has a curved surface dented inward from the inner diameter section 13 of the most protruding part by a depth of h2 [refer to FIG. 2B].

Accordingly, the inner diameter section 13 forms a circular ridge line with a diameter D1.

The inclined section 12 is formed as a surface linking the inner diameter section 13 and the outer diameter section 14.

Moreover, an intermediate diameter section 15 (shown with a double dotted and dashed line) with a diameter D3 is formed between the inner diameter section 13 and the outer diameter section 14. The intermediate diameter section 15 corresponds to a location (inflection section) in which the curvature of the surface of the inclined section 12 is remarkably changed.

The diaphragm 10 is more specifically explained below. The surface (herein after, called an inside inclined-section 12*a*) of a region within the inside (in the side of the central axis O) of the intermediate diameter section 15 within the inclined section 12 is formed as a curved surface with a curvature in the denting direction, and the surface (herein after, called the outside inclined-section 12*b*) of a region outside (in a side opposite to that of the central axis O) from the intermediate diameter section 15 is formed as a plane surface without a curvature.

Moreover, the intermediate diameter section 15 has a central axis O2 which is eccentric with regard to the central axis O of the inner diameter section 13 and that of the outer diameter section 14 by a distance $\alpha$ (eccentricity amount $\alpha$).

Accordingly, the intermediate diameter section 15 is a location at which the curvature of the surface at the side of the eccentric central axis O2 (the inside inclined-section 12*a*) and that of the surface (the outside inclined-section 12*b*) opposite to the surface at the side of the eccentric central axis O2 are discontinuous as a boundary there between, and is shown with a line circling around the eccentric central axis O2.

Moreover, the curvature R of the inside inclined-section 12*a* is not constant, and is continuously changed from a maximum Rmax to a minimum Rmin [refer to FIG. 2B] in the circumferential direction. The inside inclined-section 12*a* is formed, based on the changing curvatures R, and the eccentricity amount $\alpha$.

Then, an electroacoustic transducer 50 using the diaphragm 10 will be explained.

The electroacoustic transducer 50 is also called a speaker unit. As shown in, for example, FIG. 3, the electroacoustic transducer 50 is configured to include the diaphragm 10, a flexible edge 30 which is connected to the outer diameter section 14 of the diaphragm 10, a housing 31 to which the edge 30 is firmly fixed, and a magnetic circuit 34 which drives the diaphragm 10 fastened to the housing 31.

The magnetic circuit 34 is composed of a cup-type yoke 23 having a bottom 23*a* and a ring-type wall 23*b*, a magnet 24 fastened to the inside surface of the bottom 23*a*, and a cylinder-type pole piece 25 fastened to the magnet 24. The edge 30 as a linking member linking the diaphragm 10 and the housing 31 may be made of, for example, a rubber material and a resin material.

Moreover, a voice coil bobbin 21 and a voice coil 22, which is wound around the outer peripheral surface at one end of the voice coil bobbin 21, are inserted into a gap between the ring-type wall 23*b* of the yoke 23 and the pole piece 25. Electric power is supplied to the voice coil 22 from the outside through a lead wire 22*a*, which is taken out to the outside through a hole 31*a* provided in the housing 31.

Moreover, the outer peripheral surface of the voice coil bobbin 21 is connected to the housing 31 through an elastic damper 33. The housing 31 supports the bobbin 21 through the damper 33 so as to allow the bobbin 21 to vibrate freely in a direction (vibrating direction) parallel to the central axis O of the diaphragm 10.

A driving section 32 is configured to include the magnetic circuit 34, the voice coil bobbin 21, and the voice coil 22.

Further detailed explanation will be made, part of which will have been repeated. The ring-type edge 30 with elasticity is fixed to around the outer diameter section 14 of the diaphragm 10, and the outer periphery of the edge 30 is fastened to a ring-type frame 31*b* in the housing 31. In fastening, the diaphragm 10 is installed in such a way that the inner diameter section 13 is protruded in a direction away from the driving section 32.

One end of the voice coil bobbin 21 with a shape of a circular tube is fastened to the surface of the inner diameter section 13, wherein the surface is in the opposite side to the protruding side of the section 13 which is protruding like a circular ridge line.

The voice coil 22 is wound on the outer peripheral surface at the other end side of the voice coil bobbin 21.

Moreover, the cup-type yoke 23 is arranged in such a way that the inner wall of the ring-type wall 23*b* faces the voice coil 22 leaving a predetermined magnetic gap there between.

On the other hand, the outer peripheral surface of the disk-like pole piece 25 linked to the cylinder-type magnet 24 is arranged to face the inner surface of the voice coil bobbin 21 leaving a predetermined gap, the inner surface being opposite to the outer surface of the voice coil 21 around which the voice coil 22 is wound.

The voice coil bobbin 21 is supported through the damper 33 by the housing 31 in such a way that the bobbin 21 may be moved in the vibrating direction.

Since general-purpose components having their outer shape formed non-eccentric with regard to the central axis O are used without any modification to prepare the edge 30, the housing 31, and the driving section 32 which are to be used in the electroacoustic transducer 50, exclusive components are not necessary for the diaphragm 10, thereby preventing an increase in production costs.

Figure 3:
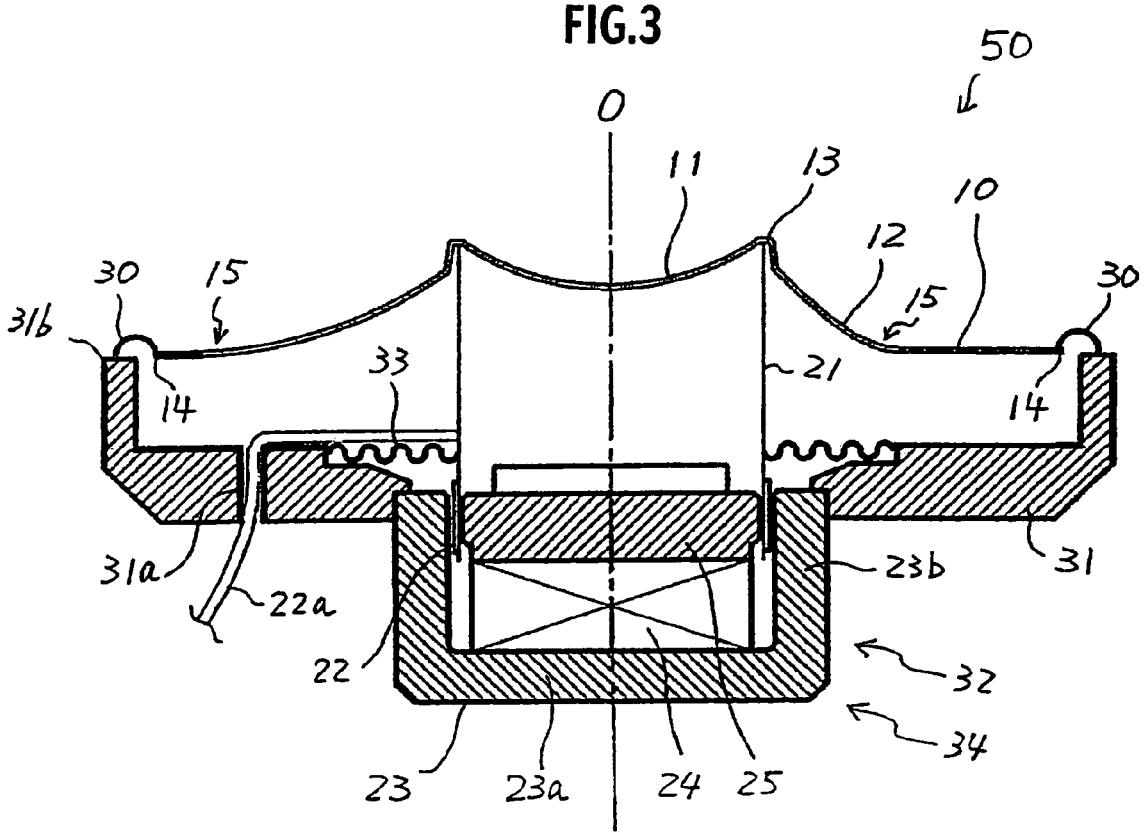
FIG. 3 is a cross-sectional view showing an electroacoustic transducer according to the first example of the present invention.

The inner diameter section 13 of the diaphragm 10 may be protruded in relation to the driving section 32 in a direction opposing to the above-described direction shown in FIG. 3, that is, in a direction toward the driving section 32. In other words, this configuration is another form in which the inner diameter section 13 is dented as shown in FIG. 4.

Figure 4:
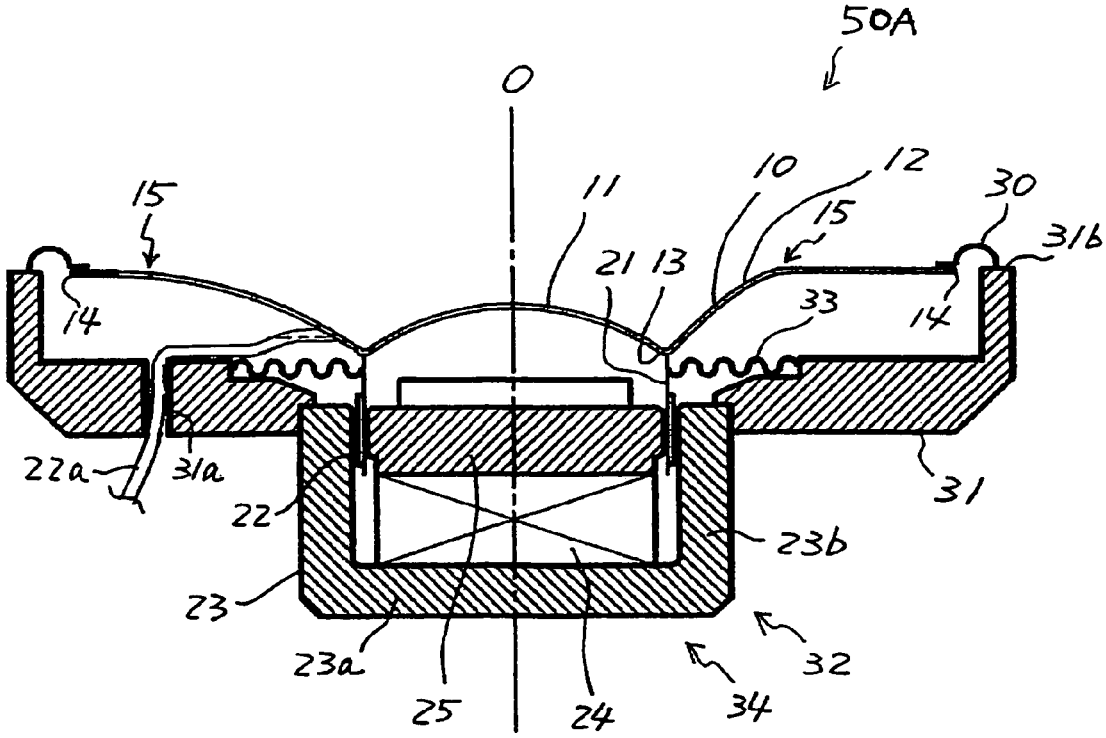
FIG. 4 is a cross-sectional view showing another example of the electroacoustic transducer according to the first example of the present invention.

In an electroacoustic transducer 50A shown in FIG. 4, the diaphragm 10 is protruded in a direction opposing to the protruding direction of the diaphragm 10 of the electroacoustic transducer 50 shown in FIG. 3, and one end of the voice coil bobbin 21 is fixed to a surface in the protruding side of the inner diameter section 13 in the diaphragm 10. Except this configuration, the electroacoustic transducer 50A has the same configuration as that of the electroacoustic transducer 50.

Accordingly, there can be used the voice coil bobbin 21 having the shorter length thereof in the direction of the central axis O than that of the electroacoustic transducer 50.

Since the electroacoustic transducer 50 in which the inner diameter section 13 is protruded outward as shown in FIG. 3 has a broader directivity than that of the electroacoustic transducer 50A with the inner diameter section 13 which is dented inward as shown in FIG. 4, the electroacoustic transducer 50 is preferably used as an electroacoustic transducer (so-called a tweeter) which emits sounds in a high-pitched range, though it is generally difficult for the transducer for high-pitched sounds to have a broad directivity.

Moreover, the electroacoustic transducer 50A in which the inner diameter section 13 is dented inward is preferable as an electroacoustic transducer (so-called a woofer) with a large diameter for low-pitched sounds because the diaphragm 10 does not protrude outward in the electroacoustic transducer 50A.

Subsequently, there will be explained as follows a characteristics comparison between the above-described case where the diaphragm 10 in which the central axis O2 of the intermediate diameter section 15 is eccentric with regard to the central axis O of the outer diameter section 14 is used and a case where a diaphragm in which the central axis O2 of the intermediate diameter section 15 is not eccentric is used.

Figure 5:
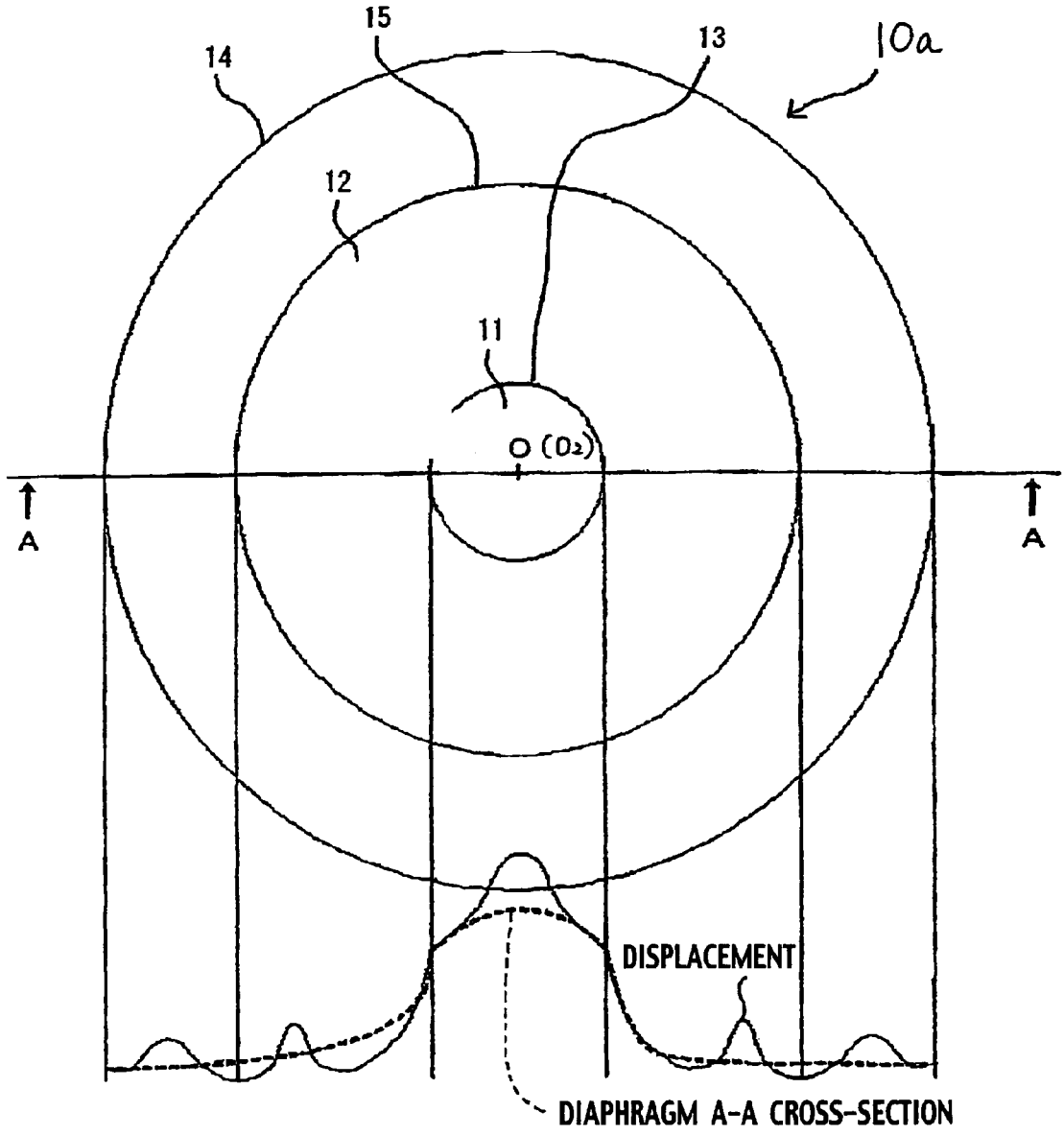
FIG. 5 is a schematic view explaining a distribution of standing waves in a conventional diaphragm.
Figure 6:
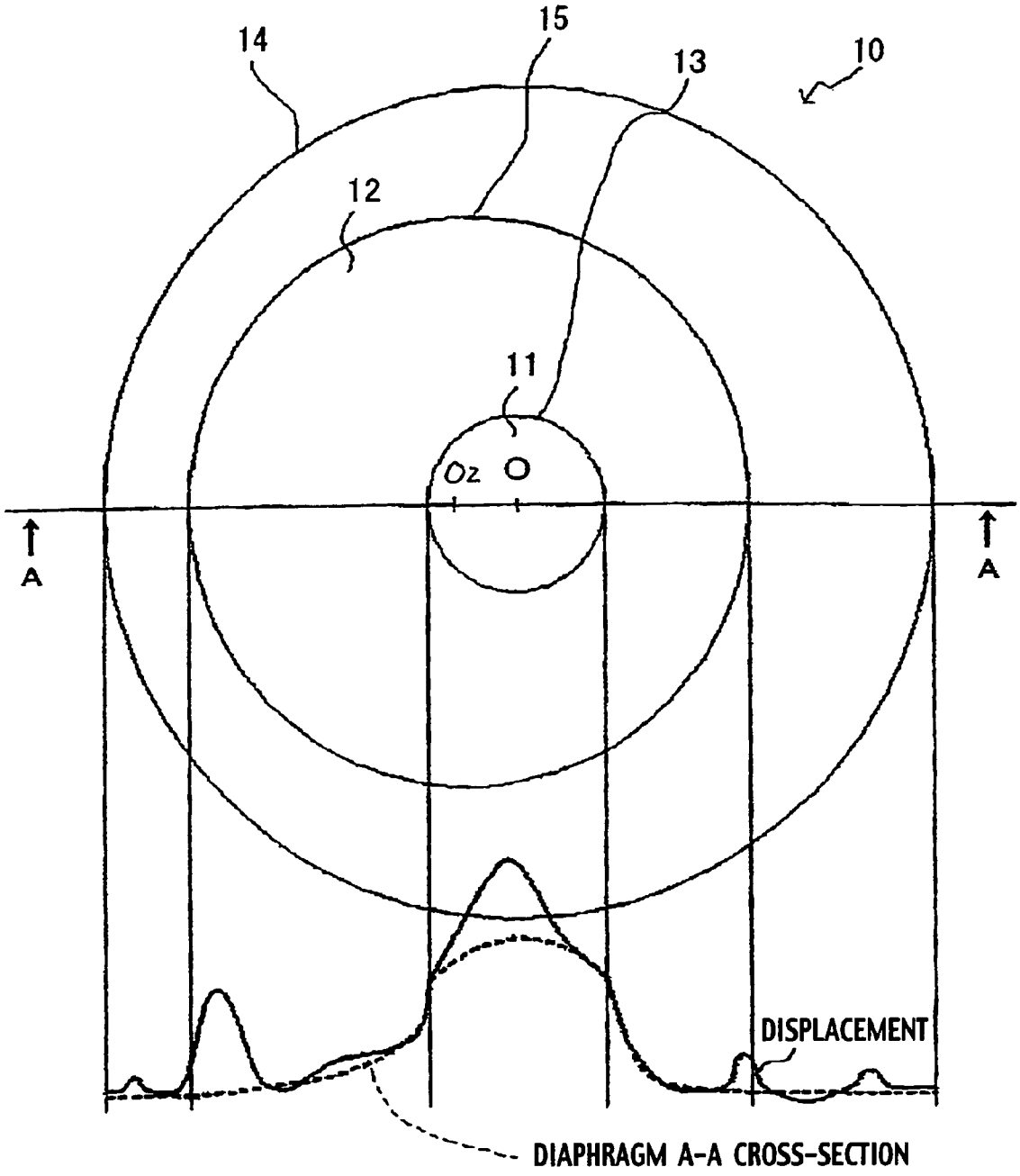
FIG. 6 is a schematic view explaining a distribution of standing waves in the diaphragm according to the first example of the present invention.

FIG. 5 shows the vibrating state of a diaphragm 10*a* (a comparison example) with a configuration in which the intermediate diameter section 15 has a central axis O2 without an eccentricity with regard to the central axis O of the diaphragm 10, and FIG. 6 shows the vibrating state of the diaphragm 10 according to the present invention, wherein the intermediate diameter section 15 has the central axis O2 with an eccentricity from the central axis O of the diaphragm 10.

FIG. 5 and FIG. 6 show the distribution of standing waves in the direction of the central axis O of each diaphragm on each of sections taken along the A-A line under a condition for analysis of the vibration, in which force determined by the effective coil length and the number of turns of the voice coil 22 is applied as sine vibration to the voice coil 22 under an actual magnetic field strength by the magnetic circuit 34, and vibration of 12 kHz is caused.

In each drawing, the upper section thereof is a plan view of each diaphragm, and the lower section thereof represents an amount of displacement caused by the vibration, corresponding to its upper section.

Specifically, the dashed lines show the cross-sectional shape of each diaphragm and the solid lines schematically show the distribution of each standing waves in the lower sections representing the displacement amounts, which are rather exaggerated.

It is found by comparison between the drawings that, when the diaphragm 10 according to the present invention is used, the standing wave is clearly asymmetry with regard to the central axis O. Moreover, the number of remarkable maxima generated in the left side and the right side with regard to the central axis O is also different from each other.

Figure 7:
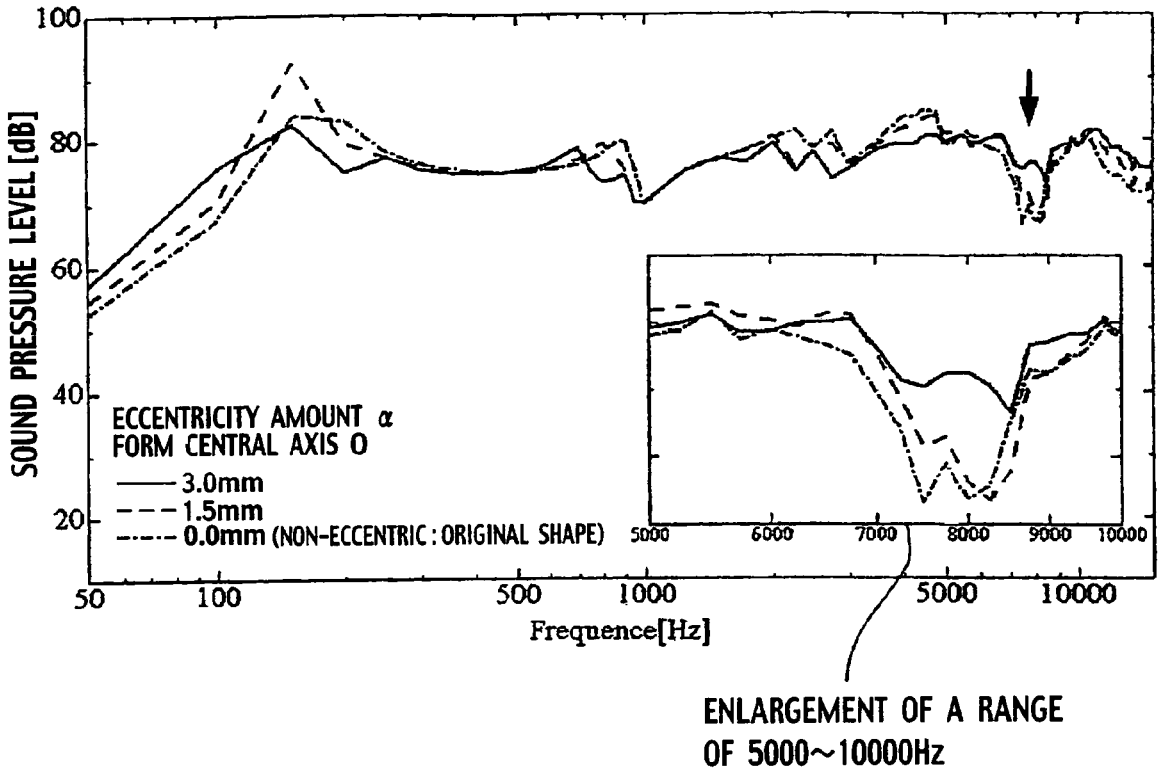
FIG. 7 is a graph showing frequency-sound pressure characteristics according to the eccentricity amounts of the diaphragm.

FIG. 7 shows frequency-sound pressure characteristics for three kinds of electroacoustic transducers: one using the diaphragm 10*a* as the comparison example shown in FIG. 5 in which the central axis O2 of the intermediate diameter section 15 and the central axis O of the inner diameter section 13 are in agreement with each other (that is, the eccentricity amount is zero); and the other two using the diaphragm 10 with an $\alpha$ of 1.5 mm, and the diaphragm 10 with an $\alpha$ of 3.0 mm, respectively, as examples according to the present invention, wherein $\alpha$ is assumed to be an eccentricity amount of the central axis O2 of the intermediate diameter section 15 from the central axis O of the inner diameter section 13.

It is found that, a deep dip is seen at nearly 8 kHz (referred to by the arrow in the drawing) when the diaphragm 10*a* as the comparison example is used. However, when there is eccentricity, the dip becomes shallow and, furthermore, when the eccentricity amount becomes larger, the dip becomes more leveled off.

Moreover, it is found that other peaks and dips become flat by the eccentricity, and the larger eccentricity amount $\alpha$ causes the peaks and dips to be more leveled.

Figures 8A, 8B, 8C:
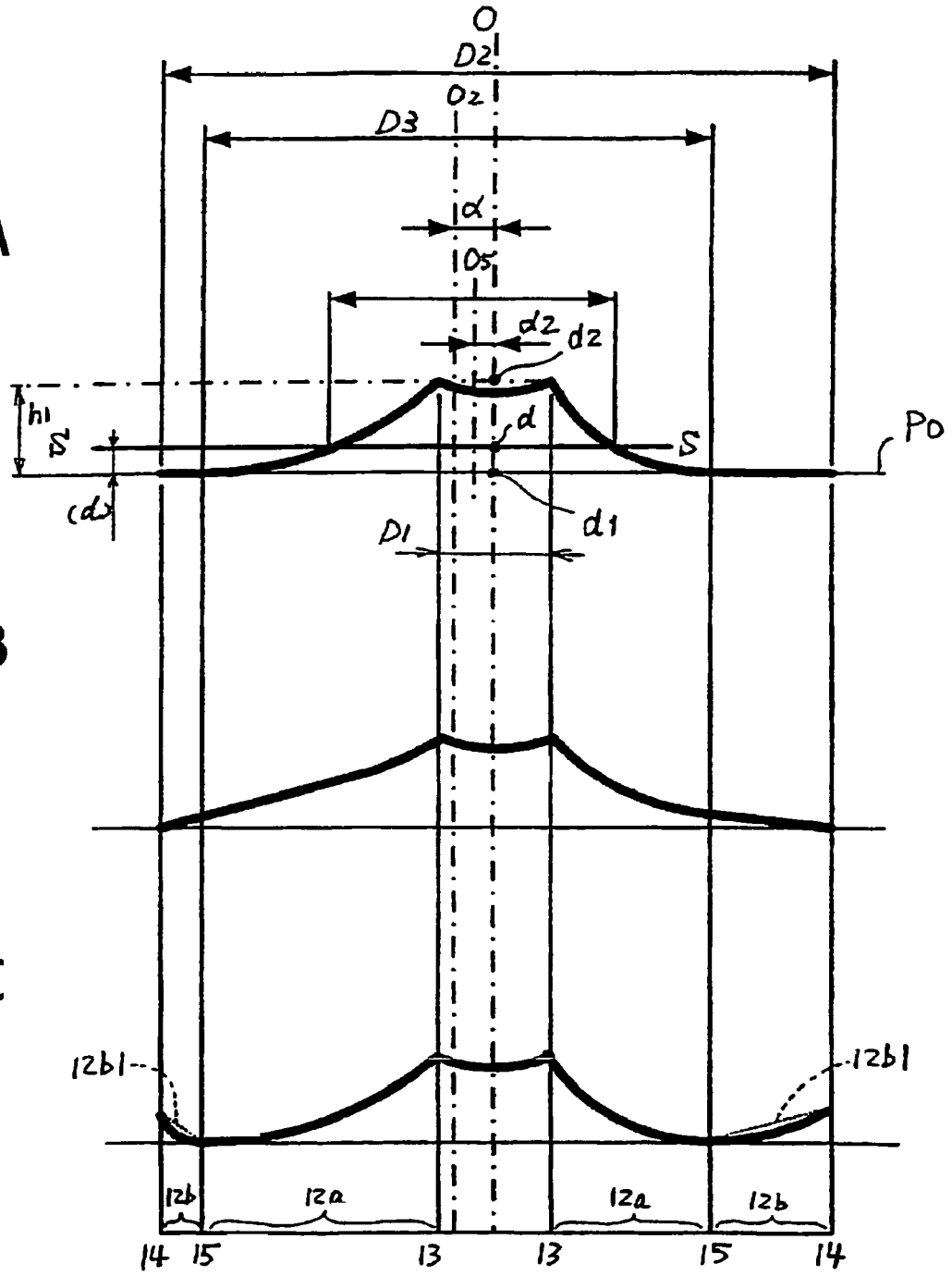
FIGS. 8A through 8C are schematic cross-sectional views explaining the shapes of a diaphragm according to the first example of the present invention.

Incidentally, the inside inclined-section 12*a* between the inner diameter section 13 and the intermediate diameter section 15 may have a curved surface shown in, for example, FIG. 8A through FIG. 8C as a cross-sectional shape in a plane passing through the central axis O. [FIG. 8A through FIG. 8C are schematic views, showing that the intermediate diameter section 15 has the central axis O2 which is eccentric to the left in the drawing, with regard to the central axis O of the outer diameter section 14.]

Concretely, FIG. 8A and FIG. 8C are examples in which the inside inclined-section 12*a* is an inclined curved surface having a curvature in such a way that the surface is dented inward as the cross-sectional shape.

Moreover, FIG. 8B is an example in which the inside inclined-section 12*a* is an inclined curved surface having a curvature in such a way that the surface is dented inward as the cross-sectional shape, and, at the same time, the outer diameter section 14 is an inclined plane without a curvature as the cross-sectional shape.

On the other hand, the outside inclined-section 12*b* between the intermediate diameter section 15 in the inclined section 12 and the outer diameter section 14 may be a curved surface shown in, for example, FIG. 8A through FIG. 8C.

Concretely, the outside inclined-section 12*b* may be a plane without an inclination as shown in FIG. 8A, or an inclined plane which is continuous from the adjacent inside inclined-section 12*a* as shown in FIG. 8B.

Moreover, the section 12*b* may be an inclined curved surface with an inclination in the opposite direction to that of the inside inclined-section 12*a* as shown in FIG. 8C, or an inclined plane 12*b*1 as shown with a dotted line in FIG. 8C.

Figures 9A, 9B, 9C:
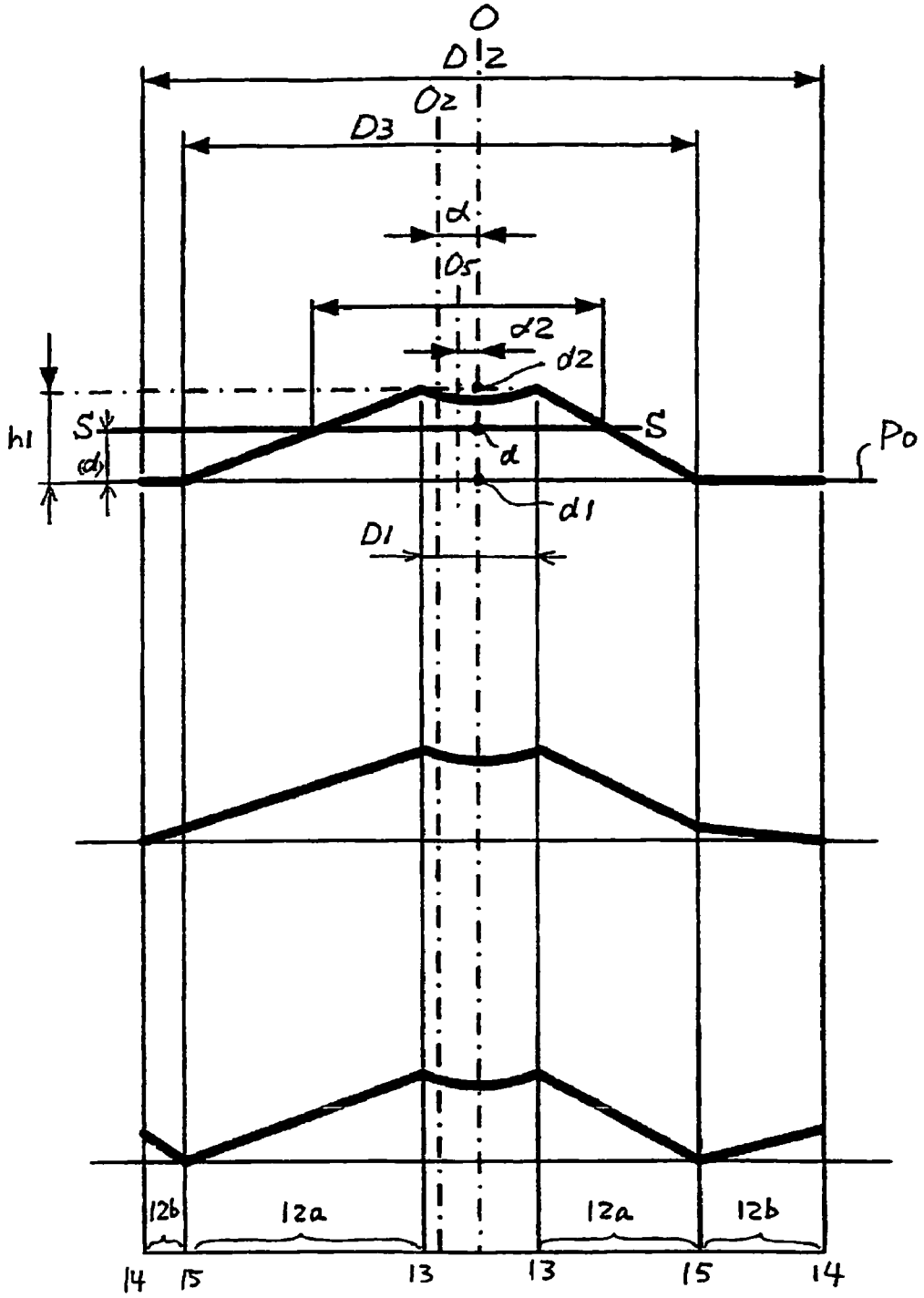
FIGS. 9A through 9C are schematic cross-sectional views explaining other shapes of diaphragm according to the first example of the present invention.

Moreover, the inside inclined-section 12*a* may be an inclined plane without a curvature in a cross-sectional shape as shown in FIG. 9A through FIG. 9C. (FIG. 9A through FIG. 9C also are schematic views, showing that the intermediate diameter section 15 has the central axis O2 which is eccentric to the left in the drawing, with regard to the central axis O of the outer diameter section 14.)

Moreover, the outside inclined-section 12*b* may be a plane without an inclination as shown in FIG. 9A, or an inclined plane with an inclination in the same direction as that of the inside inclined-section 12*a* as shown in FIG. 9B. Furthermore, the section 12*b* may be an inclined plane with an inclination in the opposite direction to that of the inside inclined-section 12*a* as shown in FIG. 9C.

Obviously, the shape of the inclined section 12 may be a combination of those shown in FIG. 8A through FIG. 8C and FIG. 9A through FIG. 9C, and the shape is not limited to the combinations.

As shown in FIG. 8A through FIG. 8C and FIG. 9A through FIG. 9C, a cross-sectional shape taken along the S-S line has a central axis O5 eccentric from the central axis O by $\alpha$2, the cross-sectional shape intersecting perpendicularly to the central axis O, and is rotationally symmetric about the eccentric central-axis O5, in the diaphragm 10 according to the present example.

Moreover, the shape of a diaphragm is not limited to a shape with rotational symmetry about the central axis O5 which is eccentric at all the positions in the direction of the central axis O from a position d1 (a position at which the central axis O and the reference plane PO intersect with each other) in the reference plane PO, which includes the outer diameter section 14, to a position d2 (a position at which the central axis O and a plane P13 including the inner diameter section 13 intersect with each other) in the inner diameter section 13, and may be a shape in which the inclined section 12 partially includes positions d at which a shape with rotational symmetry about the eccentric central-axis O5 is obtained as an eccentric surface section.

Moreover, the intermediate diameter section 15 is set as a location at which the angle of inclination angle, excluding the example shown in, for example, FIG. 8B, or a curvature of the surface of the inclined section 12 is suddenly changed, in other words, as a location as a boundary at which curvatures or angles of inclination of the two surfaces which are connected with each other are discontinuous.

Furthermore, the intermediate diameter section 15 is a location that is visually identified as a boundary line in which the reflection of light is visually different when light is irradiated from one direction.

The intermediate diameter section 15 is not limited to a complete circle, and may be a shape which has the central axis O2 with an eccentricity with regard to the central axis O and is rotationally symmetric about the eccentric central axis O2.

Similarly, the inner diameter section 13 is not limited to a complete circle, and may be a rotationally symmetric shape, for example, an ellipse.

Though the diaphragm 10 with a dented surface at the center section 11 has been explained in the above-described examples, the center section 11 may be a plane, or a protruded surface.

Moreover, the size of the center section 11, in other words, the size of the inner diameter section 13 in the radial direction may be arbitrarily set.

Accordingly, for example, when the inner diameter section 13 is assumed to be a complete circle, the size of the diameter D1 is arbitrary.

Though the example in which the outer shape of the above-described diaphragm 10 is a circle has been explained, the outer shape may be assumed to be a polygon (for example, a regular pentagon) which is inscribed in a circle. In this case, the dimensions of the polygon and the intermediate-diameter section may be set in such a way that interference does not occur between the outer shape of the polygon and the intermediate section 15.

Figure 10:
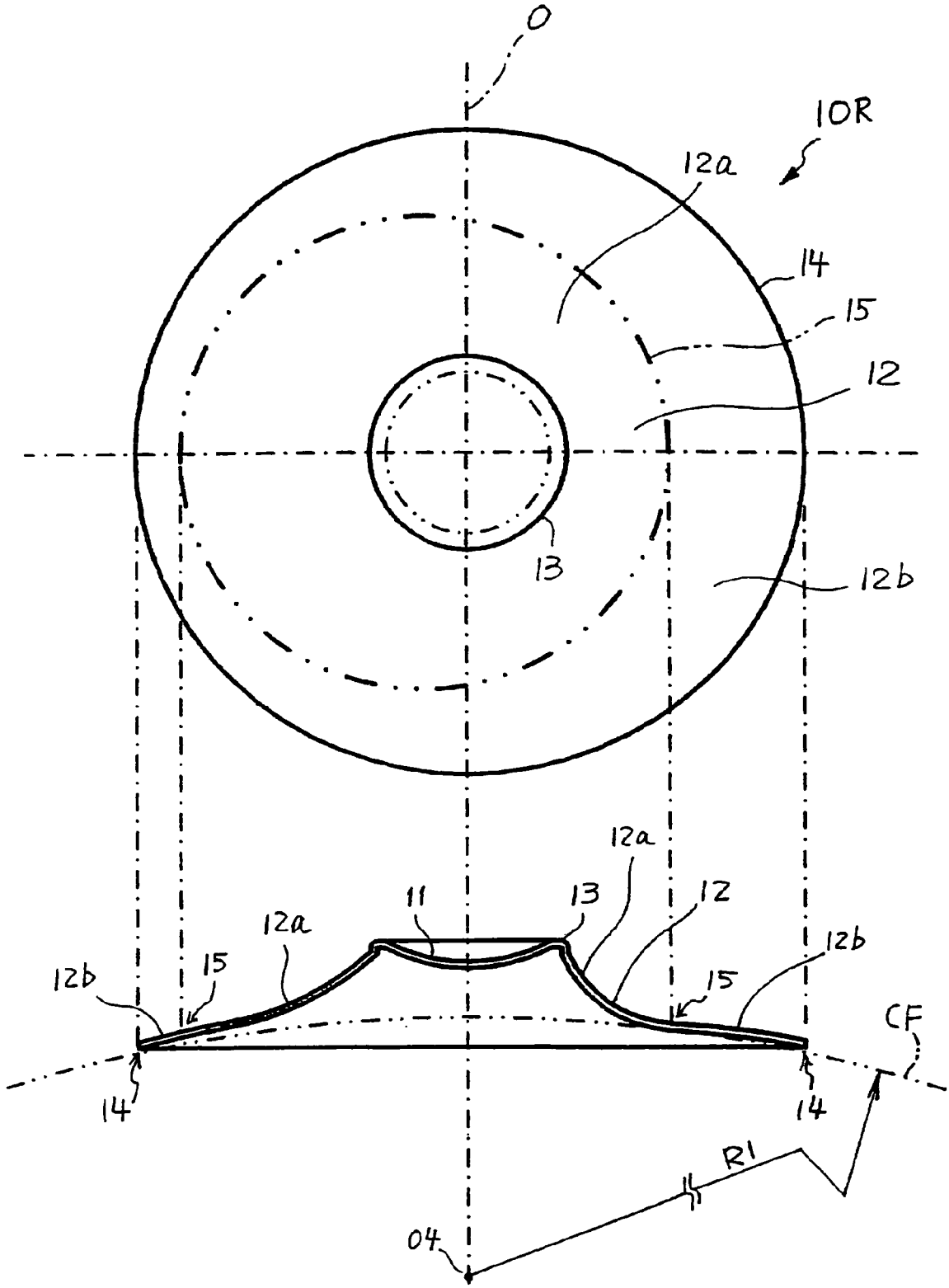
FIG. 10 is a plan view and a cross-sectional view explaining a variant of the diaphragm according to the first example of the present invention.

Moreover, the outside inclined-section 12*b* may be assumed to be a curved surface with a center of curvature O4 in the opposite side to the protruding side of the inner diameter section 13 as shown in FIG. 10.

FIG. 10 shows the cross-sectional shape of a diaphragm 10R in which, as one example, the outside inclined-section 12*b* is formed with a curved surface along a spherical surface CF with a radius R1.

This diaphragm 10R has a similar shape, except the outside inclined-section 12*b*, to that of the diaphragm 10 shown in FIG. 2A and FIG. 2B.

Since the shape of the inner diameter section 13, the outer diameter section 14 and the intermediate diameter section 15 are not limited to a circle as described above, the inner diameter section 13 may be expressed as an inner shape section 13, the outer diameter section 14 may be expressed as an outer shape section 14, and the intermediate diameter section 15 may be expressed as an intermediate shape section 15, including a case in which the shape of each section is a circle.

Since the outer diameter section 14 and the inner diameter section 13 form a concentric configuration with the central axis O in the diaphragm 10 which has been explained in detail, the electroacoustic transducer (speaker unit) 50 can be comprised of a general-purpose edge 30, a general-purpose housing 31, and a general-purpose driving section 32 provided with the magnetic circuit 34, even when the intermediate diameter section 15 has the eccentric central axis O2 with regard to the central axis O of the outer diameter section 14.

Moreover, in the case of the above-described configuration in which the outer diameter section 14 and the inner diameter section 13 have the concentric central axis O, and, at the same time, the intermediate diameter section 15 has the central axis O2 which is eccentric with regard to the central axis O of the inner diameter section 13 and that of the outer diameter section 14 by a predetermined distance α, generation of symmetric standing waves with regard to the central axis O is controlled, and peaks and dips in frequency-sound pressure characteristics may be leveled and may become flat.

Similarly, generation of symmetric standing waves with regard to the central axis O is controlled, and peaks and dips in frequency-sound pressure characteristics may be leveled and may become flat in the case of the configuration in which, in the inclined section 12, any one of the cross-sectional shapes taken along the S-S line has the central axis O5 eccentric from the central axis O, the cross-sectional shapes intersecting perpendicularly to the central axis O, and is rotationally symmetric about the eccentric central-axis O5.

Second Example

Then, a diaphragm 100 according to a second example of the present invention will be explained, referring to FIG. 11A and FIG. 11B.

Figure 11A:
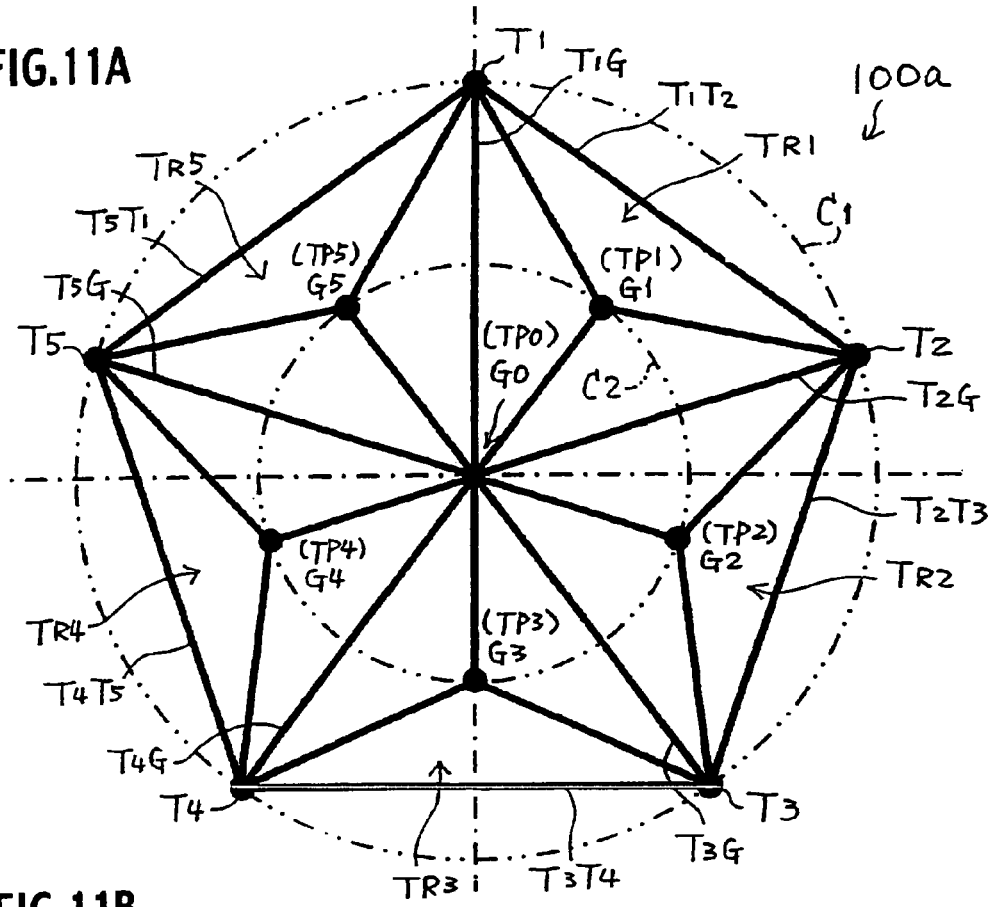
Figure 11B:
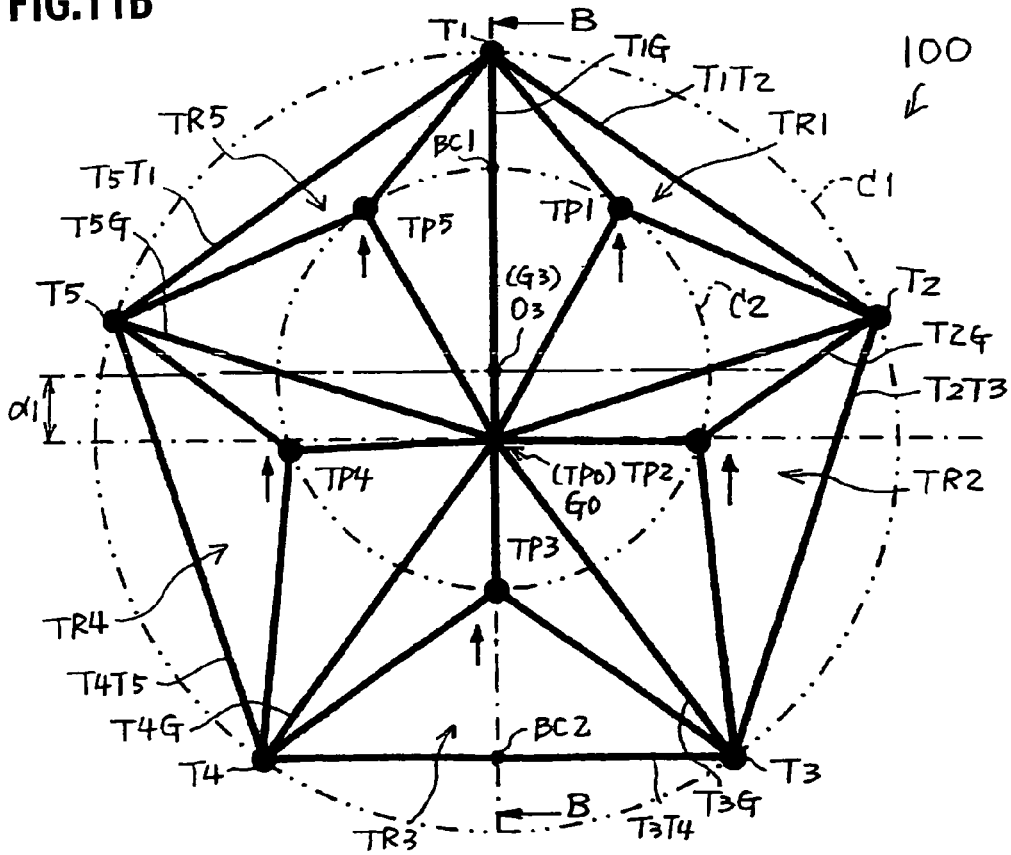

FIG. 11A and FIG. 11B are schematic plane views, in which a diaphragm 100*a* having a basic shape of the present example is shown in FIG. 11A and a diaphragm 100 is shown in FIG. 11B, for easier understanding of the shape of the diaphragm 100. Moreover, points at which line segments intersect are shown with black dots for easier understanding in FIG. 11A and FIG. 11B.

The diaphragm 100 according to the present example, which is shown in FIG. 11B, is a diaphragm configured in such a way which, the diameter D1 which can be arbitrarily set in the inner diameter section 13 according to the first example is set at nearly zero in order to be located on the central axis O of the outer shape, and at the same time, is a top portion TPO, which protrudes to one side with regard to the set reference plane PO defined by including the outer diameter section 14; and a virtual shape with rotational symmetry about an eccentric axis with regard to the central axis O is set between this top portion TPO and the outer shape, and a plurality of top portions protruding into the same side as that of the top portion TPO are provided in the virtual shape.

This diaphragm 100 is shaped in such a way that there are few planes intersecting nearly perpendicularly to a direction of sound radiation (direction of the central axis O).

The outer shape of the diaphragm 100 may be a regular n-gonal shape (n: an integer of 4 or more). Hereinafter, an example with a configuration in which n is assumed to be equal to 5, that is, an example of a regular pentagon as shown in FIG. 11B will be explained.

First of all, the diaphragm 100*a* with a basic shape shown in FIG. 11A will be explained.

The outer shape of the diaphragm 100*a* is a regular pentagon with five vertices T1 through T5. Each vertex is located on a circumscribed circle C1.

There is set a triangle TR1 defined by line segments T1G and T2G, and a side T1T2, the T1G connecting the center GO (herein after, also called a main center GO) of the regular pentagon and the vertex T1, the T2G connecting the center GO and T2, the side T1T2 being a line segment connecting vertices T1 and T2 which are adjacent to each other; and then there is set the center of gravity G1 of the triangle TR1. Similarly, there are set four triangles TR2 through TR5 defined by line segments T2G through T5G and T1G, which connect the center GO of the regular pentagon, and the vertices T2 through T5, and T1, respectively, and sides T2T3 through T5T1, respectively, that is, a line segment connecting vertices T2 and T3, through a line segment connecting vertices T5 and T1, wherein the connected vertices are adjacent to each other; and then there are set the centers of gravity G2 through G5 for the above four triangles TR2 through TR5, respectively. (In the example of the diaphragm 10*a*, the center G1 of gravity is in agreement with the center of the triangle TR1, and, similarly, the centers of gravity G2 through G5 are in agreement with the centers of the triangles TR2 through TR5, respectively.)

Here, the diaphragm 100*a* has a peaks-and-troughs shape formed by folding the diaphragm 100*a* along each line segment so that the main center G0 and the gravities G1 through G5 are positioned at the top portion TPO and the top portions TP1 through TP5, respectively, the top portions TPO, TP1 through TP5 being located away in one direction from the reference surface PO defined by the vertices T1 through T5.

Specifically, the diaphragm 100*a* is folded along the line segments T1G through T5G connecting the main center G0 and the vertices T1 through T5, respectively, in such a way that the line segments T1G through T5G become a valley line and along ten line segments connecting the vertices T1 through T5 and the gravities G1 through G5, respectively, in such a way that these line segments become a ridgeline. Moreover, the five top portions TP1 through TP5 are located on a circle C2 with the main center GO.

In contrast to the diaphragm 100*a* having such a basic peaks-and-troughs shape as described above, the diaphragm 100 according to the example has a shape in which, the positions of top portions TP1 through TP5 are moved as shown in FIG. 11B in such a way that a line linking around the top portions TP1 through TP5 are on the circle C2, and the center O3 of the circle C2 is eccentric with regard to the main center O of the regular pentagon of the outer shape (the center O is in agreement with the center of gravity GO in this example) by a predetermined amount of α.

FIG. 11B shows an example in which the eccentricity direction is a direction (the direction of the arrows in the drawing) along which the center O3 approaches the vertex T1.

Moreover, the diaphragm 100 has a configuration in which the main center GO (top portion TPO) and the top portions TP1 through TP5 are protruded in one direction with regard to the reference plane PO. The amount of each projection to reference plane PO is arbitrary determined.

Accordingly, the main center GO (top portion TPO) may be most protruded with regard to the reference plane PO, or may be less protruded than any one of the top portions TP1 through TP5. Obviously, the top portions may be protruded by the same amount.

Though it is preferable that all the top portions TPO through TP5 are located at a position which is protruded in one direction with regard to the reference plane PO as described above, only the top portions TP1 through TP5 may be located at a position which is protruded in one direction with regard to the plane PO.

Moreover, the line segment connecting the above top portion TP1 and the above-described vertex T1 and the line segment connecting the above top portion TP1 and the above-described main center GO, and, similarly, the line segments connecting the above top portions TP2 through TP5 and the above-described vertices T2 through T5, respectively, and the line segments connecting the above top portions TP2 through TP5 and the above-described main center GO, respectively, are ridgelines in folding.

Here, when the main center GO is lower than the top portions TP1 through TP5, the ridge lines from the top portions TP1 through TP5 toward the main center GO have a descending inclination, respectively, and the ridge lines from the vertices T1 through T5 toward the main center GO have an ascending inclination, respectively. Accordingly, the main center GO is called the top portion TPO as a matter of convenience.

Moreover, when the main center GO is higher than the top portions TP1 through TP5, the ridgelines from the main center GO toward the top portions TP1 through TP5 have a descending inclination, respectively, and the ridge line from the vertex T1 toward the top portion TP1, and, similarly, the ridge lines from the vertices T2 through T5 toward the top portions TP2 through TP5 have an ascending inclination. Accordingly, TP1 through TP5 are called the top portions TP1 through TP5 as a matter of convenience, respectively.

When the protruding amounts of the top portions TP1 through TP5 with regard to the reference plane PO are different from one another, the diaphragm 100 may have a configuration in which the top portions TP1 through TP5 may not be included on the same plane. Moreover, the diaphragm 100 may have a configuration in which all the top portions TP1 through TP5 are included on the same plane, and the plane may not be parallel to the reference plane PO.

The outer shape of the diaphragm 100 according to this example is not limited to the above-described regular pentagon, but also may be a regular n-gonal shape.

That is, the outer shape of the diaphragm 100 is a regular n-gonal shape (n: an integer of 4 or more), and the diaphragm 100 has a shape in which the regular n-gonal shape is divided into n counts of triangles TR1 through TRn with the n number of line segments linking the center (center of gravity) GO and the vertices T1 through Tn, the positions of arbitrary points TP1 through TPn within each triangle are set in such a way that the center O3 of a shape defined by the line C2 linking around the points TP1 through TPn is eccentric with regard to the center GO of the regular n-gonal shape by a distance $\alpha$, and, at the same time, the center GO and the points TP1 through TPn are located as top portions which are protruded in one direction with regard to the reference plane PO set by including the vertices T1 through Tn.

Here, the line C2 linking around the points TP1 through TPn may not be a circle, but may be a rotationally symmetric shape.

Moreover, the main center GO and the top portions TP1 through TPn may be protruded in one direction with regard to the reference plane PO including the vertices T1 through Tn, and the protruding amount of the center and the portions with regard to the reference plane PO is arbitrary.

Thus, all the top portions TPO through TPn are preferably located at positions which are protruding in one direction with regard to the reference plane PO, but only the top portions TP1 through TPn may be protruded in one direction.

Moreover, the line segment connecting the above top portion TP1 and the above-described vertex T1 and the line segment connecting the above top portion TP1 and the above-described main center GO, and, similarly, the line segments connecting the above top portions TP2 through TPn and the above-described vertices T2 through Tn, respectively, and the line segments connecting the above top portions TP2 through TPn and the above-described main center GO, respectively, are ridgelines in folding.

Accordingly, the main center GO may be most protruded with regard to the reference plane PO, or may be less protruded (protruded lower) than any one of the top portions TP1 through TPn. Obviously, the top portions may be protruded by the same amount.

When the protruding amounts of the top portions TP1 through TPn with regard to the reference plane PO are different from one another, the diaphragm 100 may have a configuration in which the top portions TP1 through TPn may not be included on the same plane. In this case, the diaphragm 100 may have a configuration in which all the top portions TP1 through TPn are included on the same plane, and the plane may not be parallel to the reference plane PO.

When the inner periphery of the edge 30 is fixed to the outer periphery of the diaphragm 100 in such a way that the inner periphery of the edge 30 is continuous with the outer periphery of the diaphragm 100, and, at the same time, the outer periphery of the edge 30 is fixed to a general-purpose circular frame, using the above-described diaphragm 100 and the edge 30 having a circular outer peripheral shape and an inner peripheral shape corresponding to the outer peripheral shape of the diaphragm 100, an electroacoustic transducer (speaker unit) can be easily manufactured as having a configuration in which the diaphragm 100 is supported with a frame through the edge 30 so that the diaphragm 100 may freely vibrate, while preventing an increase in cost by using a driving section provided with a general-purpose frame and a magnetic circuit.

Moreover, since vibration of the voice coil bobbin 21 may be more efficiently transmitted to the diaphragm 100, it is preferable that the voice coil bobbin 21 is attached to positions corresponding at least to the top portions TP1 through TPn of the diaphragm 100.

Furthermore, when the voice coil bobbin 21 is fixed to the surface of the diaphragm 100, the surface facing opposite to the direction in which the top portions TP1 through TPn of the diaphragm 100 are protruded, a broader directivity may be obtained.

Figure 12:
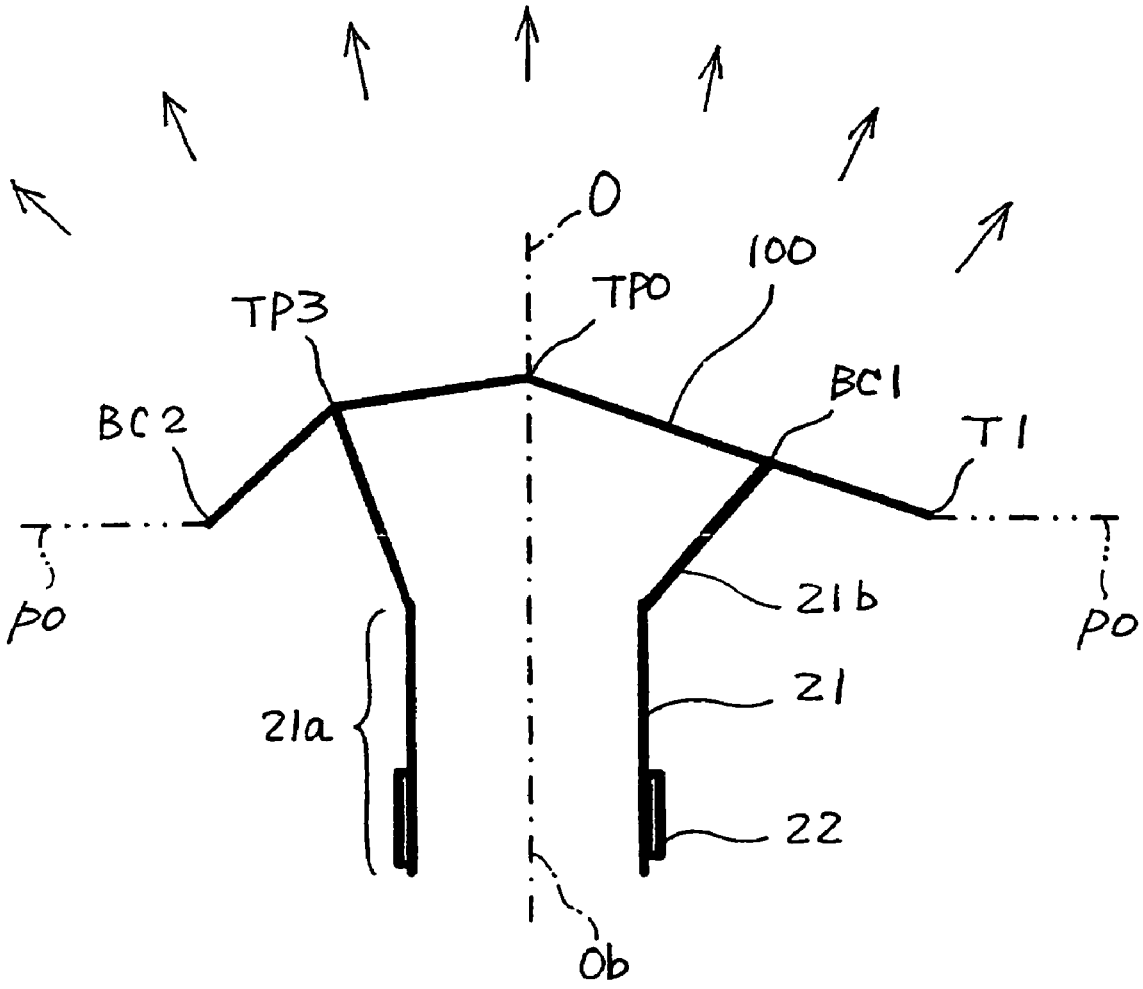
FIG. 12 is a schematic cross-sectional view explaining an electroacoustic transducer according to the second example of the present invention.

FIG. 12 shows schematically the diaphragm 100 and the voice coil bobbin 21, both of which are connected as described above. In FIG. 12, sounds are radiated with a broader directivity in the direction of the arrows shown in the drawing.

FIG. 12 is a sectional view taken along the B-B line in the diaphragm 100 shown in FIG. 11B, wherein BC1 represents an intersecting point of the line segment T1G in the diaphragm 100 and the circle C2 as a rotationally symmetric shape, and BC2 represents the midpoint of the side T3T4.

The voice coil bobbin 21 is composed as having a cylinder section 21*a* and an attachment section 21*b* which is continuously connected with one end of the section 21*a* and broadens toward the opening thereof. The voice coil 22 is wound around the outer surface at the other end of the cylinder section 21*a*.

The tip of the attachment section 21*b* is adhered fixedly to the position corresponding to the circle C2 (Refer to FIG. 11B) linking around the top portions TP1 through TP5 of the diaphragm 100.

Moreover, the voice coil bobbin 21 is fastened in such a way that a tube axis Ob and an axis (that is, the central axis O of the outer shape of the diaphragm 100) are in agreement with each other, wherein the axis passes through the top portion TPO of the diaphragm 100 so as to intersect perpendicularly to the reference plane PO.

The tube axis Ob of this voice coil bobbin 21 is in agreement with the central axis of the driving section 32.

An electroacoustic transducer using this diaphragm 100 provides an advantage that peaks and dips in frequency-sound pressure characteristics may become flat as described with reference to FIG. 7, because the distribution of standing waves is asymmetry with regard to the central axis O at an arbitrary section including the central axis O.

Moreover, since the diaphragm 100 has no plane intersecting perpendicularly to the central axis O and any planes are inclined to the axis O, reduction in sound pressure (difference of sound pressure at the front) due to angular deviation from the central axis O is smaller even in a high-pitched range in which the directivity is likely to be sharp in a listening region near the central axis O, that is, at the front of the diaphragm 100. Consequently, nearly omnidirectional characteristics may be obtained in the electroacoustic transducer using the diaphragm 100.

When the directivity is nearly omnidirectional, the electroacoustic transducer using this diaphragm 100 is advantageous for use in a particular use environment, for example, in a hall, in a wide room, and on the street, in which a listening position is not limited to a small space. Moreover, it is much preferable that, when a listening position is near the above electroacoustic transducer, the sound localization is shifted only restrictedly and comfortably even when a listening position is changed.

Furthermore, based on laborious studies by the inventors, it has been found that the shape of a diaphragm with characteristics by which the sound pressure is less changed according to listening positions and the directivity is nearly omnidirectional is, in the diaphragm 100 according to this example, a shape in which the main center GO is most protruded with regard to the reference plane PO, and that the protruded main center GO, the top portions TP1 through TPn, and the vertices T1 through Tn of the outer shape are included in one spherical surface with a predetermined curvature.

This is because, though the surface shape is slightly corrugated, the surface shape is a nearly part of a spherical surface as the whole diaphragm 100.

Therefore, radiation axes representing the direction along which sound is projected are distributed uniformly in the direction perpendicular to the spherical surface.

Accordingly, an electroacoustic transducer using the above-described diaphragm 100 may enjoy not only a frequency-sound pressure characteristics with reduced peaks and dips but lower directional difference in sound pressure, that is, quasi omni directional characteristics.

Here, when n of the regular n-gonal shape representing the outer shape of the above-described diaphragm 100 according to the second example is made infinitely large, the outer shape of the diaphragm 100 becomes a circle, and, at the same time, the number of top portions TP1 through TPn becomes infinite.

This means that the infinitely large numbers of top portions make a circle (equivalent to the intermediate diameter section 15 in the diaphragm 10) whose center is the central axis O and the circle provides a boundary at which the curvatures or inclination angles of the two surfaces that meets thereat are discontinuous.

That is, the diaphragm 10 according to the first example may be considered as a diaphragm which is obtained by making n infinitely large in the diaphragm 100 according to the second example. Accordingly, it is easily understood that the diaphragm 10 according to the first example, and the diaphragm 100 according to the second example are two forms conceivable based on the technological thought of the present invention.

APPLICATION EXAMPLE

Figure 13:
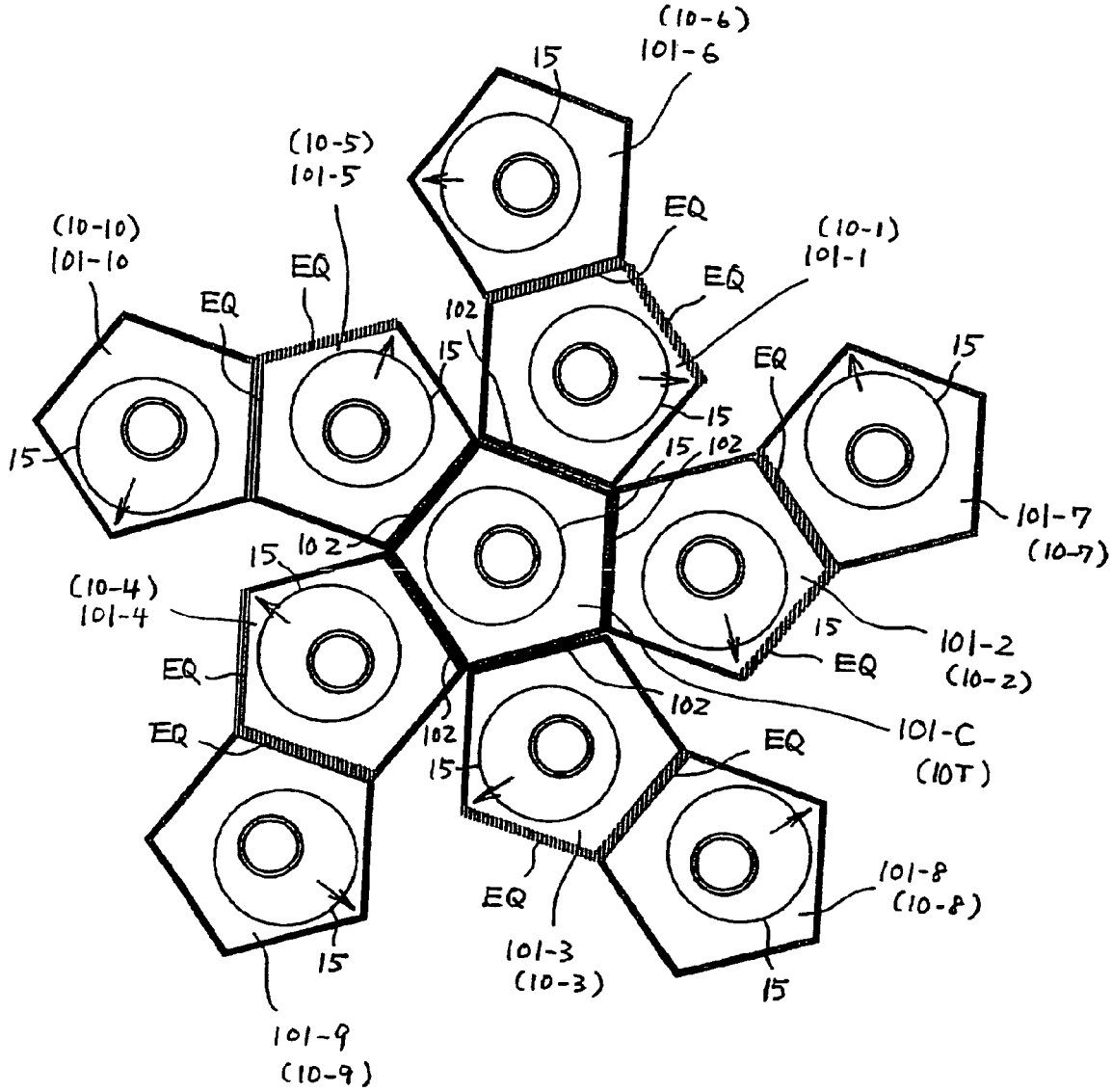
FIG. 13 is a development view explaining a diaphragm according to an application example of the present invention.
Figure 14:
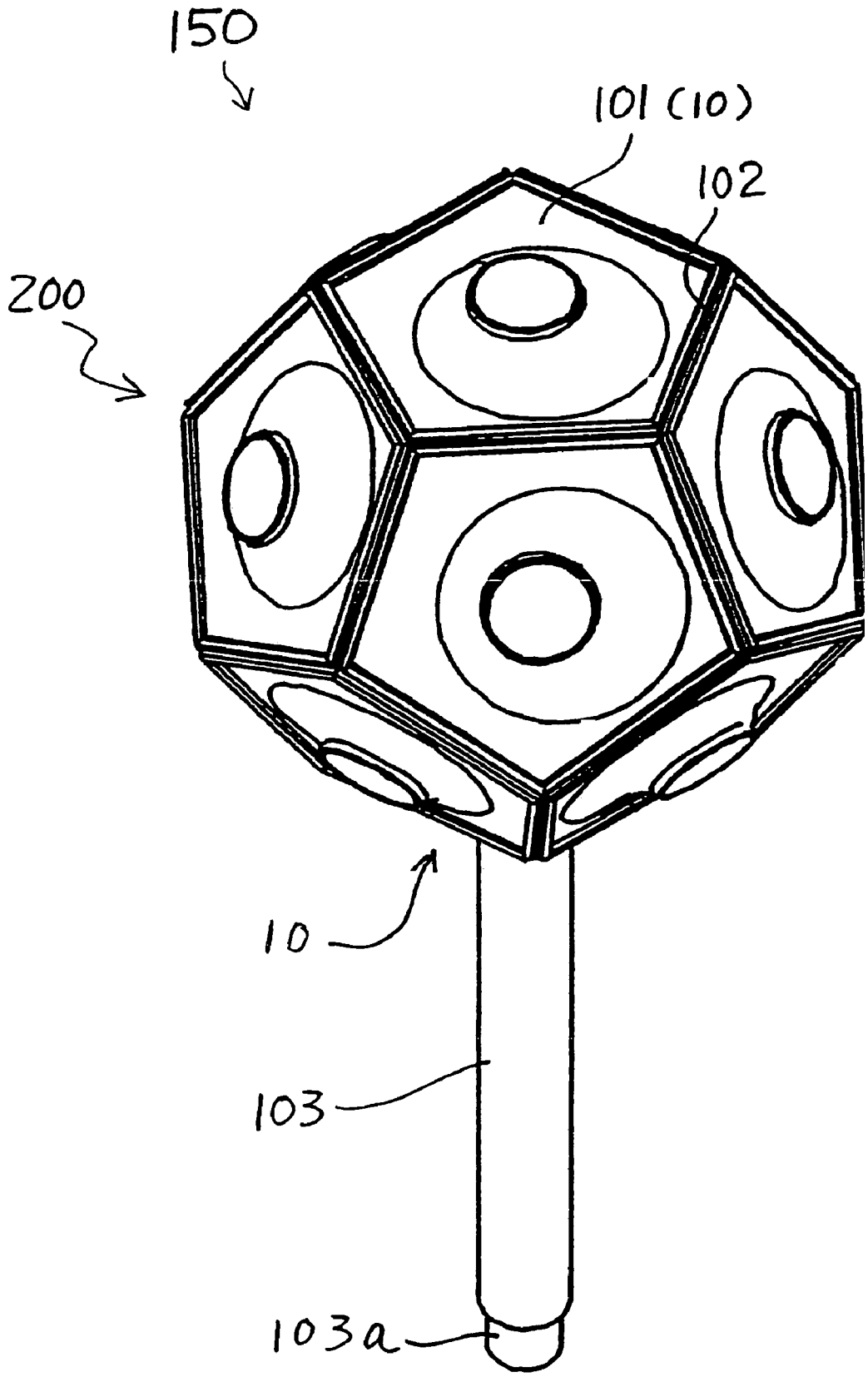
FIG. 14 is an appearance view showing an electroacoustic transducer according to the application example of the present invention.

Then, the outer shape of the above-described diaphragm 10 according to the first example is assumed to be a regular pentagon, and is developed and arranged as shown in FIG. 13, and a plurality of pieces are bonded to obtain a nearly regular dodecahedron as a diaphragm 200 as shown in FIG. 14. Hereinafter, the diaphragm 200 and an electroacoustic transducer 150 using the diaphragm 200 will be described in detail as one application example.

Moreover, there will be described later as a variant of the application example a diaphragm 201 with a shape of a nearly regular dodecahedron, which is made by using the diaphragm 100 according to the second example, instead of the diaphragm 10 according to the first example, and an electroacoustic transducer using the diaphragm 201.

Furthermore, as described above, the diaphragms 200, 201 are configured by combining the diaphragms 10, 100, respectively. Hereinafter, such configurations are referred to as a spherical shell diaphragm (spherical shell diaphragm) as a matter of convenience, considering that these configurations correspond to a hollow sphere.

FIG. 14 shows an external view of the electroacoustic transducer 150 as this application example. In some cases, the electroacoustic transducer 150 is called, for example, a spherical speaker, considering the form, and is also called, for example, a pulsating-sphere speaker, considering the vibration mode of the diaphragm 200.

This electroacoustic transducer 150 includes: the spherical shell diaphragm 200 with a shape of a nearly spherical shell (herein after, also called a spherical shell diaphragm 200 as described above in order to distinguish from a single diaphragm); a driving section 232 (not shown) provided with the magnetic circuit 234 (not shown) which drives the spherical shell diaphragm 200 arranged in this spherical shell diaphragm 200 in the radial direction; and a supporting leg 103 which supports the driving section 232 and extends from the spherical shell diaphragm 200.

Though the details will be described later, the magnetic circuit 234 includes: a cup-type yoke 223; a magnet 224 fastened to the inside surface of the bottom 223*a* of the yoke 223; and a pole piece 225 fastened to the magnet 224.

Moreover, the driving section 232 includes: the magnetic circuit 234; a voice coil bobbin 221; and a voice coil 222.

Then, the spherical shell diaphragm 200 will be explained, referring to FIG. 13. In order to form the spherical shell diaphragm 200 as described above, eleven pieces of the diaphragms 10 with an outer shape of the regular pentagon are prepared; the side of one diaphragm 10 and that of another diaphragm 10 are butted together, and bonded together through an flexible edge 102 for combination; the same processing is performed for other diaphragms; and eleven surfaces of the regular dodecahedron are formed.

In other words, the surface of a sphere having a predetermined diameter is virtually divided into twelve pieces of regular pentagons, and the diaphragm 10 is applied to each of eleven pieces of the regular pentagons among the twelve-divided regular pentagons.

Accordingly, in the diaphragm 200, one of the twelve regular pentagons of the regular dodecahedron is missing and left open.

Hereinafter, it is assumed that the individual diaphragms 10 may be called a segment 101.

Referring back to FIG. 14, one (one surface shown with the arrow in FIG. 14) of the twelve surfaces, that is, the opening is closed with a plate (not shown), instead of the diaphragm 10, wherein the plate is provided with a hole through which the supporting leg 103 passes.

This plate is bonded to the spherical shell diaphragm 200 through the flexible edge 102.

Moreover, the supporting leg 103 passing through the hole is also fastened thereto.

At one end 103*a* of the supporting leg 103 can be attached an installation pedestal (not shown) and thus the electroacoustic transducer 150 per se can be installed on the floor. Or, the electroacoustic transducer 150 may be suspended from the ceiling.

Figure 15:
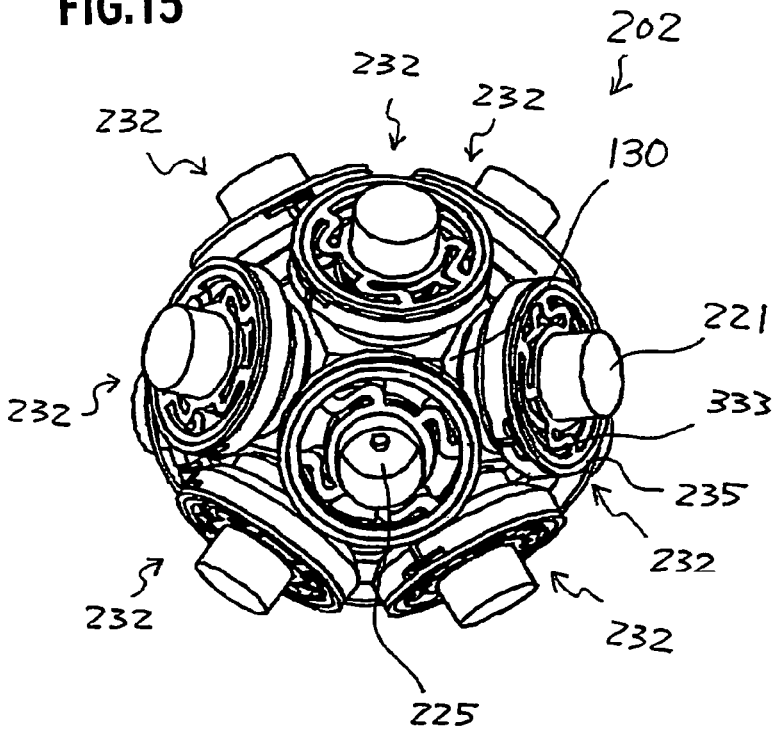
FIG. 15 is a perspective view explaining the structure of the electroacoustic transducer according to the application example of the present invention.

This electroacoustic transducer 150 is provided with eleven pieces of the driving sections 232 in total as seen from FIG. 15 showing a state in which the spherical shell diaphragm 200 is removed, wherein each of the driving sections 232 is in one-to-one correspondence to the individual diaphragms 10.

Subsequently, a configuration of the driving section 232 and the like corresponding to one segment 101 for each of the diaphragms 10 will be explained, referring to FIG. 16.

Figure 16:
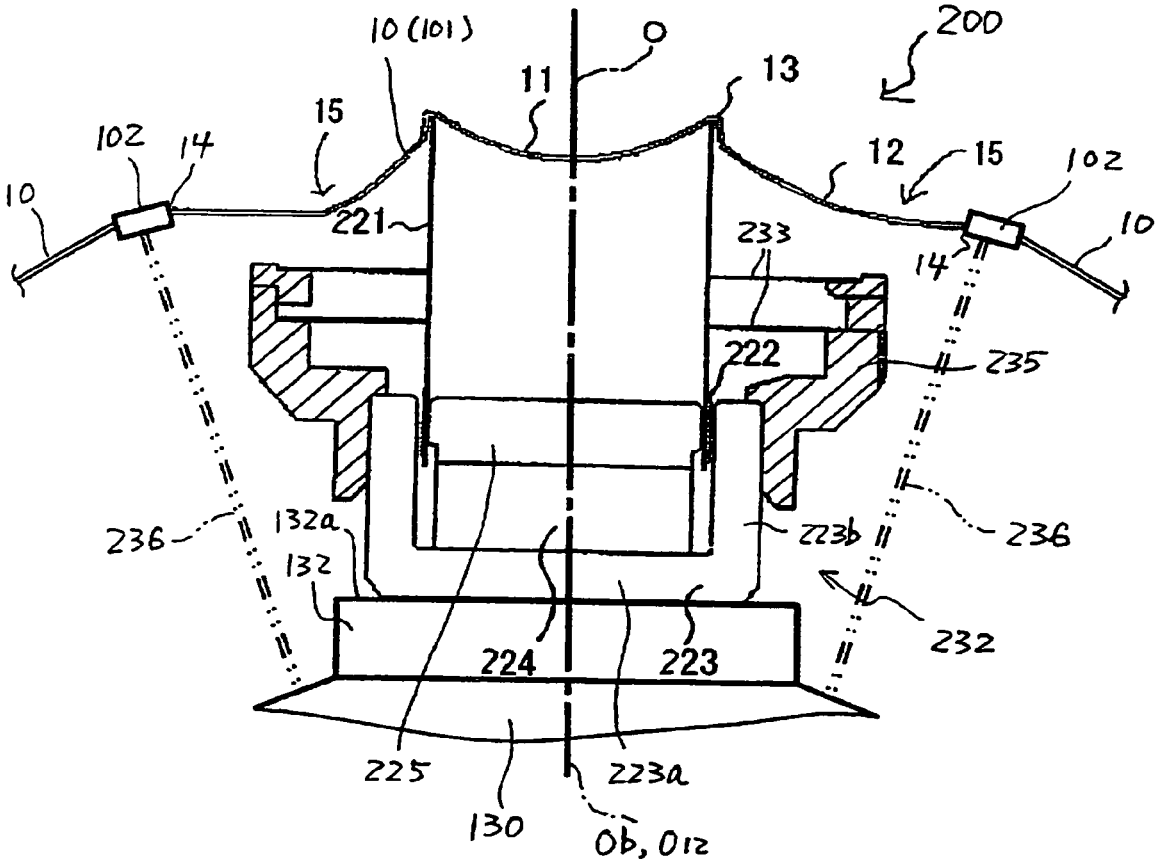
FIG. 16 is a partial cross-sectional view explaining the electroacoustic transducer according to the application example of the present invention.

FIG. 16 shows where the housing 31 is removed; one end of the diaphragm 10 as the segment 101; and one end of an adjacent diaphragm 10 are connected to each other through the edge 102 as a linking member, in comparison with FIG. 3. And, only a part of the adjacent diaphragm 10 is illustrated in the drawing.

One end of the voice coil bobbin 221 with a shape of a circular tube is linked and fastened to the surface of the inner diameter section 13 in the diaphragm 10, the surface facing opposite to the direction in which the section 13 protrudes.

In this state, the central axis O of the outer shape of the diaphragm 10 and the tube axis Ob of the voice coil bobbin 221 are in agreement with each other.

The voice coil 222 is wound around the outer peripheral surface at the other end of the voice coil bobbin 221.

In the outside of the voice coil 222, the cup-type yoke 223 is arranged in such a way that the inner peripheral surface of the annular wall 223*a* faces the outer peripheral surface of the voice coil 222 with a gap there between.

Moreover, the cylinder-type pole piece 225 coupled to the magnet 224 is arranged inside the voice coil bobbin 221, facing the inner peripheral surface of the bobbin 221 leaving a gap there between.

Moreover, a ring type frame 235 is fastened to the yoke 223.

The voice coil bobbin 221 and the frame 235 are connected with each other through two elastic dampers 233, and the voice coil bobbin 221 is elastically supported through the damper 233 in such a way that the bobbin 221 may be moved with regard to the frame 235 in the parallel direction to the central axis O.

Moreover, the magnet 224 is fastened to the bottom 223*a* of the yoke 223, and the yoke 223 is fastened to an installed surface section 132*a* of a support platform 132.

A diaphragm driving section to be used to drive a diaphragm having the outer shape in which the central axis corresponds to the tube axis Ob of the voice coil bobbin 221 may be used, as it is, for the driving section 232.

Figure 17:
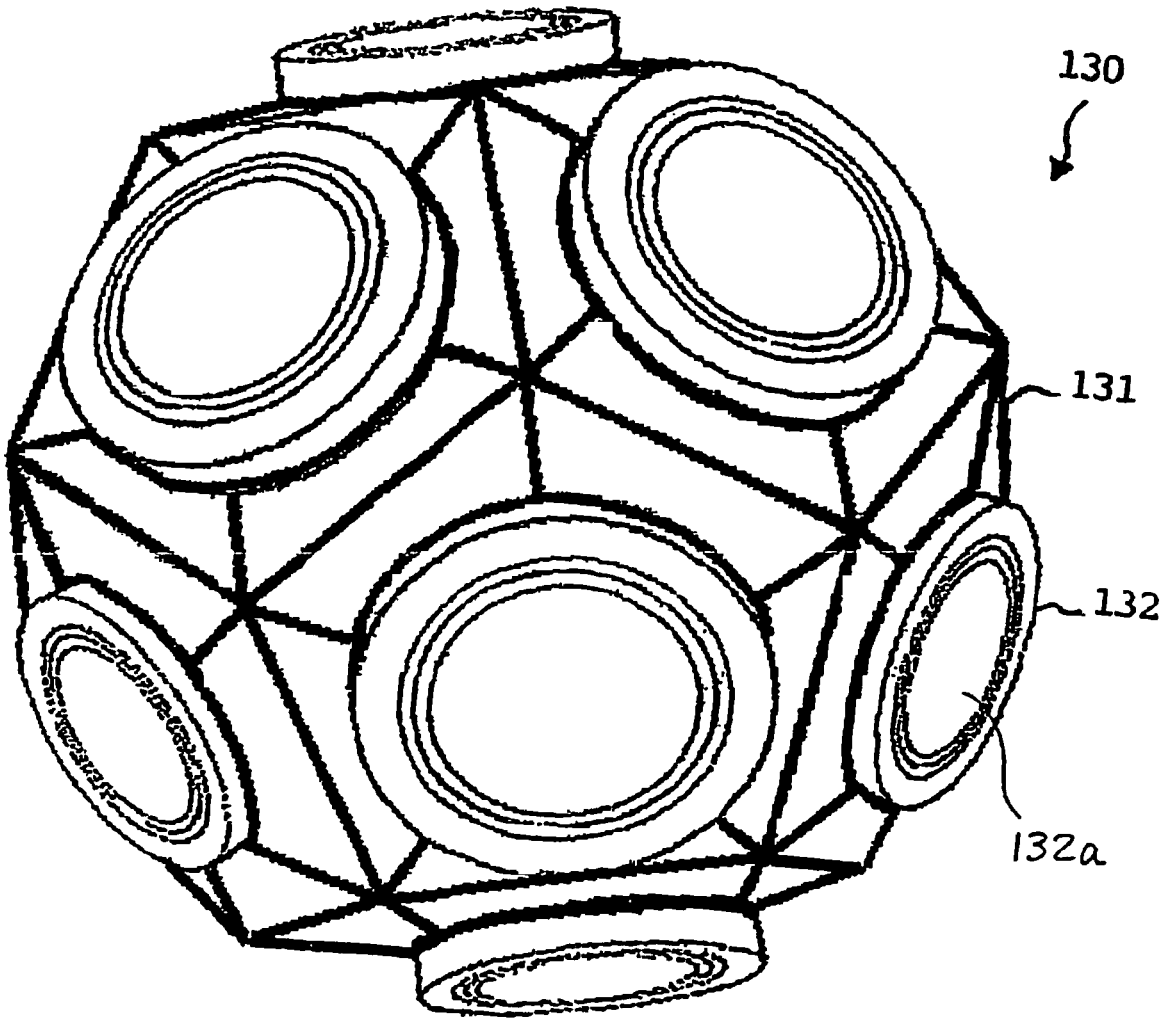
FIG. 17 is a perspective view explaining the structure of another electroacoustic transducer according to an application example of the present invention.

As shown in FIG. 17, one support platform 132 is attached to each of the eleven of twelve dodecahedral surfaces of a base 130 that has been assembled into nearly a regular dodecahedron along with a base frame 131. That is, eleven support platforms 132 are provided on the base 130.

To the remaining one of the twelve surfaces is attached the supporting leg 130, though not shown.

Moreover, as shown in FIG. 16, the bottom face of the yoke 223 is fastened to the installed surface section 132*a* of the support platform 132 as described above in such a way that the central axis O12 of each surface of the regular dodecahedron and the tube axis Ob as the central axis of the driving section 232 are in agreement with each other.

Accordingly, the electroacoustic transducer 150 is comprised of the base 130 with the outer shape of a nearly regular dodecahedron; eleven support platforms 132 fastened to the base 130 in such a way that the installed surface sections 132*a* are located respectively in the eleven of twelve surfaces of the regular dodecahedron; and eleven pieces of the driving sections 232 fastened respectively to the installed surface sections 132*a* of the support platforms 132, wherein the voice coil bobbin 221 in each of the driving section 232 is linked to each of the eleven diaphragms 10 of the spherical shell diaphragm 200 that has been formed into nearly a spherical shell by assembling the eleven diaphragms 10 having an outer shape of the regular pentagon correspondingly to the eleven of the twelve surfaces of the regular dodecahedron.

Therefore, the electroacoustic transducer 150 has a configuration in which the spherical shell diaphragm 200 is supported on the voice coil bobbins 221 in such a way that the central axis O of each of the diaphragms 10 and the tube axis Ob of the voice coil bobbin 221 of each of a plurality of driving sections 232 are in agreement with each other; the spherical shell diaphragm 200 is driven in such a way that the diaphragm 200 is vibrated in the normal direction to the sphere circumscribed with the regular dodecahedron, thereby radiating sounds.

Thereby, the directional difference in sound pressures, the difference being generally caused depending on the directions in which the sounds are radiated, is reduced, thereby radiating sounds almost in all directions.

Accordingly, when the above electroacoustic transducer 150 is installed in, for example, a hall to radiate sounds therethrough, an excellent sound field full of realistic sensation is created irrespective of a listening point.

Furthermore, an excellent sense of realism may be obtained when listening to the radiated sounds at a position near the electroacoustic transducer 150 because sound localization is not extremely moved, but is smoothly changed even when a listening position is moved.

When the above-described diaphragm 10 is used as individual diaphragms, since the intermediate diameter section 15 has the central axis O2 which is eccentric with regard to the central axis O while the outer diameter section 14 and the inner diameter section 13 have the concentric central axis O, generation of symmetric standing waves with regard to the central axis O is reduced, and thus peaks and dips in frequency-sound pressure characteristics can be less pronounced.

Moreover, when the diaphragm 10 has the outer diameter section 14 and the inner diameter section 13, both of which have the concentric central axis O, and at the same time, an eccentric surface section whose cross-section taken along the direction perpendicular to the central axis O in the inclined section 12 has the eccentric axis O2 eccentric to the central axis O, generation of symmetric standing waves with regard to the central axis O is reduced, and thus peaks and dips in frequency-sound pressure characteristics can be less pronounced.

Moreover, when the diaphragm 10R shown in FIG. 10 as a variant of the diaphragm 10 is used as individual diaphragms, the spherical shell diaphragm 200 is more similar in the appearance to a sphere, and is improved in the appearance and the quality as a spherical speaker, because the outside inclined-section 12*b* is curved along a part of a spherical surface CF.

Subsequently, as a variant of this application example, eleven pieces of diaphragms 100 [refer to FIG. 11B, and FIG. 18A], instead of the diaphragm 10, are butted and bonded together at their sides through a flexible edge 102, thereby to form the spherical shell diaphragm 201 with a shape of a nearly spherical shell. The external view of the spherical shell diaphragm 201 is shown in FIG. 18B, though the supporting leg 103 is eliminated in the drawing.

Figure 18A:
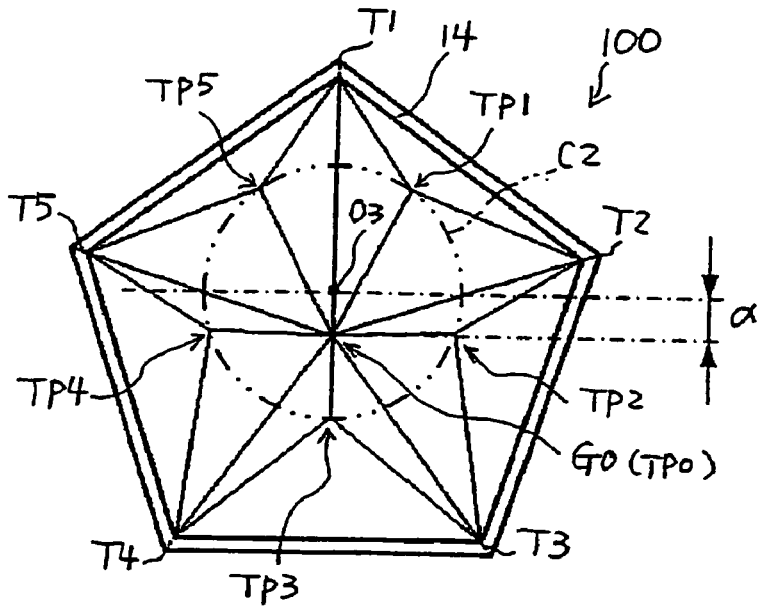
FIG. 18A is a front view explaining a variant of the diaphragm according to the application example of the present invention.
Figure 18B:
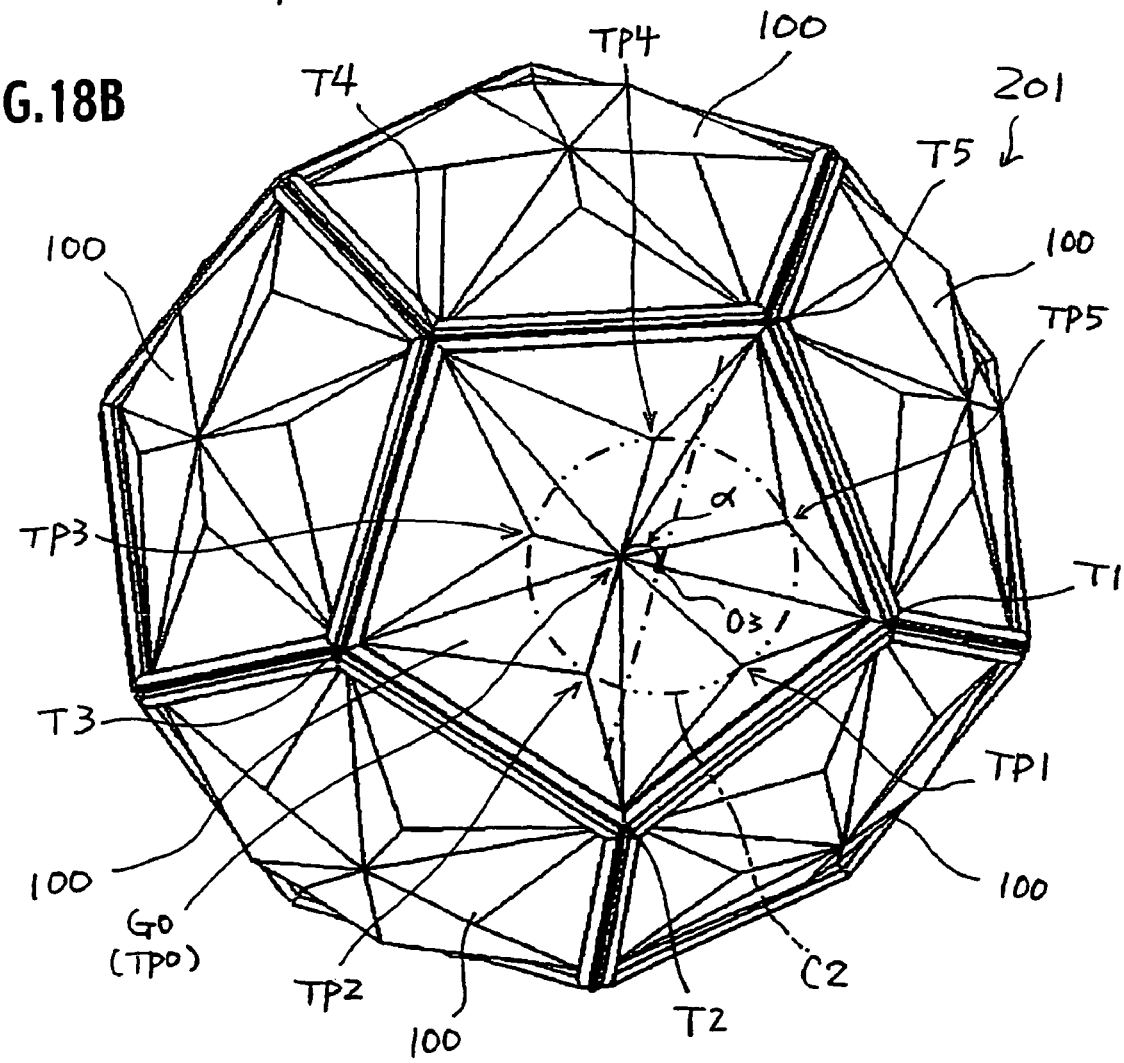
FIG. 18B is a perspective view explaining the variant of the diaphragm according to the application example of the present invention.

As shown in FIG. 18A and FIG. 18B, each individual diaphragm 100 has an outer shape of a regular pentagon having vertices T1 through T5.

Moreover, in FIG. 18A, the shape C2 linking the top portions TP1 through TP5 is a circle, and the center O3 thereof is deviated with regard to the main center GO of the regular pentagon in the direction toward to the vertex T1 by a distance α.

Moreover, as seen from FIG. 18B, the main center GO and the top portions TP1 through TP5 are protruded in the outward direction with regard to the reference plane PO that is formed as including the vertices T1 through T5, in a way the protruding amount of the main center GO is the largest.

Moreover, the voice coil bobbin 221 bonded to the diaphragm 100 is the voice coil bobbin 221 explained with FIG. 12, and is adhered fixedly to a surface facing the driving section 232 so as to abut at least the positions corresponding to the top portions TP1 through TP5 of the diaphragm 100.

When the spherical shell diaphragm 201 according to this variant is used, the diaphragms 100 the center GO of the outer shape is made the top portion TPO protruding into one side with regard to the reference plane PO including the vertices T1 through T5, and, at the same time, a plurality of protruding top portions TP1 through TP5 are provided between the center GO and the outer shape (outer diameter section 14), the center O3 of the shape C2 is made eccentric from the center GO of the outer diameter section 14 wherein the shape C2 is obtained by linking the top portions TP1 through TP5, and any of the diaphragm surfaces are configured to be inclined with regard to a direction intersecting perpendicularly to the reference plane PO, that is, the radiating direction of sounds. Accordingly, omnidirectional characteristics may be obtained because peaks and dips in frequency-sound pressure characteristics may become flat, and, at the same time, difference in sound pressure becomes small wherein the difference in sound pressure is caused by difference in angles to an axis (the central axis of the diaphragm 100) which is passing through the center GO, and is intersecting perpendicularly to the reference plane PO.

Each diaphragm 100 is configured in such a way that the center GO is set to be the top portion TPO protruded away in one direction from the reference plane PO including the vertices T1 through T5; the central axis O3 of the shape C2 obtained by connecting the top portions TP1 through TP5 that are provided between the center GO and the outer shape (the outer diameter section 14) so as to protrude in one direction is eccentric to the center GO of the outer diameter section 14; and all the surfaces of the diaphragm are inclined in relation to the direction that is perpendicular to the reference plane P0 and sound is projected along. Therefore, when such a diaphragm 201 according to this variant is used, peaks and dips in frequency-sound pressure characteristics can be less pronounced and directional difference in sound pressure, which is measured by detecting sound pressure at various positions deviated from the axis perpendicular to the reference plane P0 (the center axis of the diaphragm 100), can be reduced. In other words, characteristics much closer to omnidirectional are obtained.

Furthermore, when the diaphragm 100 is configured, as described in detail in the explanation of the diaphragm 100, in such a way that the center GO is protruded most with regard to the reference plane PO; and the protruding center GO, a plurality of top portions TP1 through TP5, and vertices T1 through T5 of the outer shape are included in a sphere with a predetermined curvature, the directional difference in sound pressure can be less pronounced, the directional difference being measured by detecting sound pressure at various points deviated from the central axis O of the diaphragm 100. Accordingly, the above configuration is preferable when omnidirectional characteristics are required.

In addition, when the predetermined curvature is in agreement with that of the surface of the spherical shell diaphragm 201, the whole shape of the spherical shell diaphragm 201 becomes more similar to a complete sphere. Therefore, the directional difference in sound pressure becomes much less pronounced, the directional difference being measured by detecting sound pressure at various points deviated variously from the central axis O of the diaphragms 100 and thus the directional characteristics becomes further improved. Accordingly, there is preferably provided an advantage that the directional characteristics as the spherical shell diaphragm 201 becomes much closer to omnidirectional.

When the spherical shell diaphragms 200 and 201 are formed, using the above-described diaphragms 10, 10R or the diaphragm 100, and the eccentricity directions of the diaphragms 10, 100 are set at a predetermined direction, the changes in sound pressure preferably becomes further reduced in a case in which this electroacoustic transducer 150 is set up, for example, on the floor, and listening positions are changed, especially, in the latitude direction (top-and-bottom direction). The eccentricity direction will be explained, referring to FIG. 19.

Figure 19:
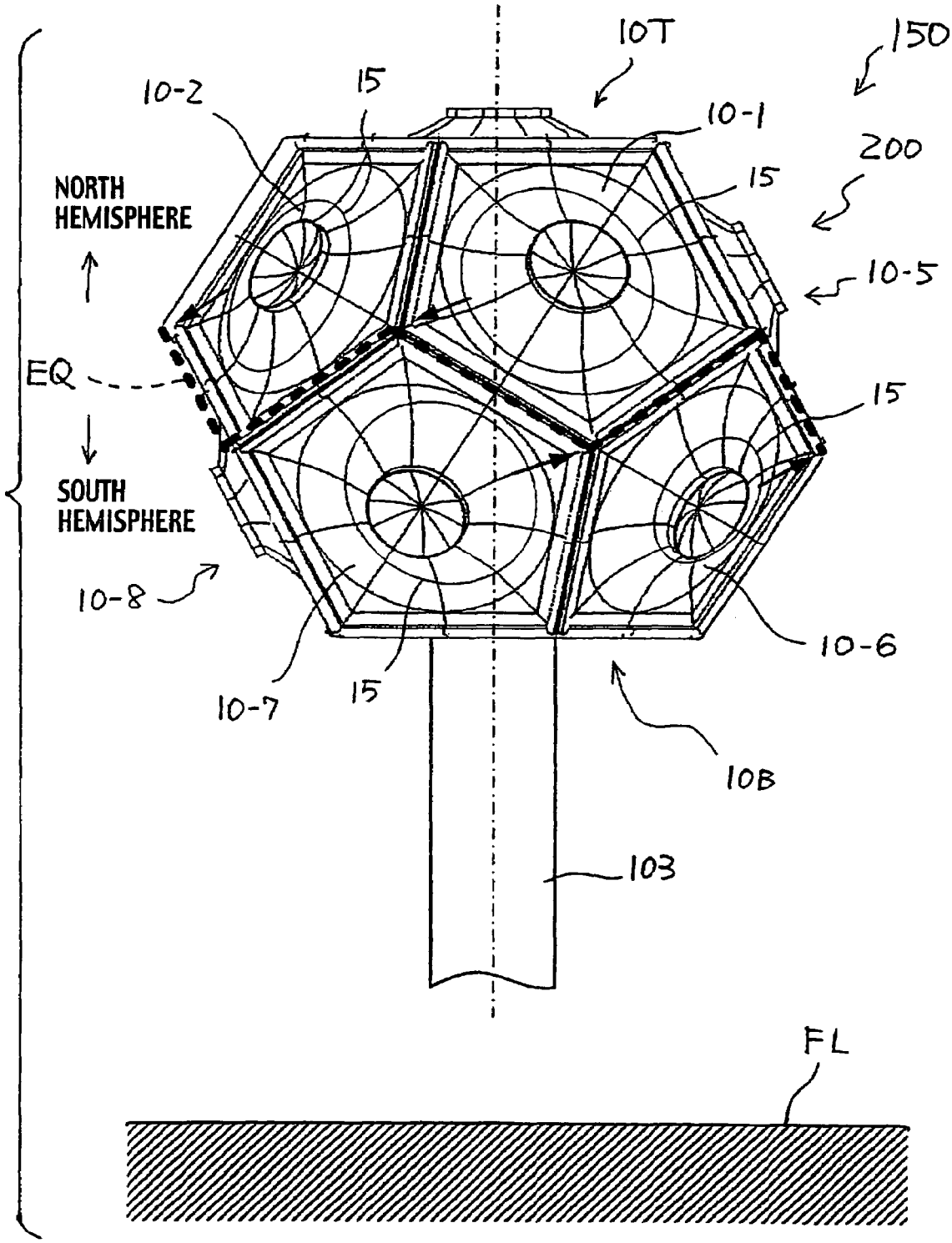
FIG. 19 is a front view explaining the electroacoustic transducer according to the application example of the present invention.

FIG. 19 is a front view showing where the above electroacoustic transducer 150 is set up in such a way that the diaphragm on the top face opposing to the plate on the bottom face 10B installed with the supporting leg 103 is assumed to be a diaphragm 10T, and the diaphragm 10T is set up parallel to the floor FL. This is one example for set up of the transducer. The diaphragm in FIG. 19 is the spherical shell diaphragm 200 using the diaphragm 10 according to the first example.

In the above configuration, sides on which five diaphragms 10-1 through 10-5 connected with the top face diaphragm 10T are bonded with five diaphragms 10-6 through 10-10 connected with the plate on the bottom face 10B form a zigzag line EQ and serve as a boundary through which the spherical shell diaphragm 200 is vertically divided into two. This line EQ is shown with a bold dotted line in FIG. 19.

Assuming that this spherical shell diaphragm 200 is considered as a globe, the line EQ is called an equator EQ; the portion from the equator EQ toward the top face is called the North Hemisphere; and the portion from the equator EQ toward the bottom face is called the South Hemisphere, herein after.

With regard to both the diaphragms 10-1 through 10-5 in the North Hemisphere, and the diaphragms 10-6 through 10-10 in the South Hemisphere, the preferable eccentricity direction of the diaphragms 10 (100) is a direction toward a vertex on the equator EQ.

When the eccentricity direction is set as described above, the change in sound pressure preferably becomes smaller even when the listening position is changed in the latitude direction (that is an up-down direction in FIG. 19).

In addition, it is more preferable that, in the circumferential direction, the eccentricity direction of the diaphragms 10-1 through 10-5 in the North Hemisphere is opposite to that of the diaphragms 10-6 through 10-10 in the South Hemisphere as shown in FIG. 19.

More specifically, it is recommendable that, as shown by the arrows in FIG. 19, the eccentricity direction in the diaphragms 10-1 through 10-5 in the North Hemisphere is a direction toward a vertex on the equator EQ in a right-handed direction, and the eccentricity direction in the diaphragms 10-6 through 10-10 in the South Hemisphere is a direction toward a vertex on the equator EQ in a left-handed direction seen from the top face. However, the right-handed and left-handed directions may be reversed.

Thus, when the eccentricity directions of the diaphragms on both sides of the line EQ as a boundary, through which the spherical shell diaphragm 200 is divided into two, are different from each other in the circumferential direction, the change in sound pressure, which takes place in association with a change of listening position in the latitude direction, is leveled and becomes further smaller.

This line EQ is not limited to a line parallel to the floor FL. The direction of the line EQ may be appropriately set according to listening positions in such a way that the best directivity is realized at a listening position.

Moreover, since the supporting leg 103 may be also extended in an arbitrary direction, the extending direction of the supporting leg 103 does not restrict the set direction of the line EQ.

On the other hand, it is preferable that when a listening position is guessed, the eccentricity direction of the diaphragm 10T on the top face is set as a direction approaching the listening position. Thereby, when the listening position is vertically moved at the listening position, the change in sound pressure becomes smaller.

Incidentally, when the edge 102 is formed of a specially soft material, or when the spherical shell diaphragm 200, or 201 is comparatively large, the edge 102 and the base 130 may be linked together with a support medium 236 as shown with two-dot chain lines in FIG. 16 in order to prevent deformation of the shape due to the own weight of the spherical shell diaphragm 200, or 201.

This support medium 236 supports the spherical shell diaphragm 200 or 201 as an aid to the voice coil bobbin 221, and is formed of an elastic material that prevents deformation of and has no influence on the diaphragm.

The edge 102 linking the diaphragms 10, 10R, and 100 as a linking member is bonded to the diaphragms 10, 10R, and 100, using an adhesive agent. However, the edge 102 is not necessarily used. For example, the diaphragms 10, 10R, and 100 may be bonded with one another using an adhesive agent. In this case, it is obvious that this adhesive agent serves as a linking member.

<Manufacturing Process>

Then, manufacturing processes for the electroacoustic transducer 150 according to the application example will be explained, referring, mainly, to FIG. 13.

In this following, an example of manufacturing the spherical shell diaphragm 200 of a nearly regular dodecahedron will be explained, and the spherical shell diaphragm 200 is formed by combining a plurality of the diaphragms 10. Similarly, the diaphragm 10R, and the diaphragm 100, instead of the diaphragm 10, may be used for the manufacturing.

(Process 1)

In the first place, a plane-type or a sheet-type diaphragm material is processed by press working or reducing work to make the diaphragm 10 corresponding to individual segments 101. As described above, a sheet of paper, metal, resin, ceramics, and wood, or the like, may be used as the diaphragm material. A sheet to be used may be produced by laminating one or more kinds of the above sheets.

(Process 2)

Subsequently, eleven pieces of segments 101 are arranged in a planar configuration as shown in FIG. 13. Sides of individual segments 101 to be bonded with each other are butted while keeping such a configuration, and then are bonded with each other through each of flexible edges 102. For example, a rubber material, or a resin material may be used for the edge, and a known adhesive agent may be utilized for the bonding.

In this example, focusing on one segment 101-C as a center segment, two segments 101 are continuously bonded to each side of the center segment.

Specifically, adjacent five segments 101-1 through 101-5 are bonded to the center segment 101-C, and, then, other segments 101-6 through 101-10 are bonded to the corresponding segments 101-1 through 101-5, respectively, in FIG. 13.

In this bonding form, two sides (shown in a striped pattern in FIG. 13) apart from the segment 101-C are the line EQ.

By the way, when the segments 101 are arranged in plane, the segments 101 are arranged in such a way that the eccentricity direction of the intermediate diameter section 15 in each of the segments 101 has a direction (direction shown with the arrow in FIG. 13) toward a vertex on the equator EQ after combination as described above.

When comparing the arrangement shown in FIG. 13 with FIG. 19, for example, the segment 101-C is the diaphragm 10T on the top face; the segment 101-1 through 101-5 are the diaphragms 10-1 through 10-5 on the North Hemisphere; and the segments 101-6 through 101-10 are the diaphragms 10-6 through 10-10 on the South Hemisphere.

(Process 3)

On the other hand, the support platforms 132 are attached respectively on eleven surfaces of the base 130 that has been beforehand formed into a nearly dodecahedron by combining the base frames 131, as shown in FIG. 17.

Then, the bottom 223*a* of the yoke 223 is fastened to the installed surface section 132*a* of the support platforms 132 with an adhesive agent and the like. The driving section 232 has been formed by installing the magnet 224 and the like to which the pole piece 225 has been beforehand fixed, onto the yoke 223.

(Process 4)

A movable element such as the voice coil bobbins 221 around which the voice coil 222 is wound is installed to a fixed element such as the yoke 223 and the magnet 224 through the damper 233 after positioning of the both components in such a way that the both components are located at a predetermined position as shown in FIG. 16. An adhesive agent may be also used for bonding at this installation.

An assembly 202 after the above assembling is shown in FIG. 15.

(Process 5)

Subsequently, the eleven pieces of segments 101 which have been partially bonded to one another at the process 2 are placed so as to cover the assembly 202 installed with eleven pieces of the driving sections 232.

The above process is performed in such a way that each of the segments 101 is corresponding to the voice coil bobbins 221 which have been installed at the process 4.

Then, the end of the voice coil bobbin 221 is adhered to the inside surface of each of the segments 101 with an adhesive agent in such a way that the central axis O of each of the segments 101 is in agreement with the tube axis Ob of the voice coil bobbin 221.

(Process 6)

Since, under the above conditions, the sides of the segments 101, which have not been bonded at the process 2, are to be located in such a way that the sides are approximately butted to one another, those sides are bonded through the flexible edges 102 with an adhesive agent to form the spherical shell diaphragm 200 with a shape of a nearly spherical shell.

(Process 7)

The supporting leg 103 is fastened to the base 130; the plate closing the opening of the spherical shell diaphragm 200 is arranged in the opening; and the plate is bonded to the spherical shell diaphragm 200 and the supporting leg 103. The supporting leg 103 does not have to be installed into the base 130 at the last process, but may be installed at one of other arbitrary processes beforehand.

According to the above-described processes, the electroacoustic transducer 150 is manufactured.

According to this manufacturing process, sides of the segments 101 to be bonded under a state in which the individual segments 101 are arranged in plane are bonded beforehand at the process 2, and sides which have been remained unbonded at the process 2 are bonded at the subsequent process 5. Accordingly, positioning of components facing with each other may be simplified when the segments 101 are assembled into a spherical shell and the spherical shell diaphragm 200 may be easily assembled.

Moreover, general-purpose driving section 232 having a rotationally symmetric shape about the central axis O can be used, because the segments 101 have a configuration in which the central axis O of a polygon as an outer shape and the driving central axis Ob (the tube axis of the voice coil bobbin 221) of the driving section 232 are in agreement with each other. Furthermore, the movable elements and the fixed elements can be aligned with each other in a simple and accurate manner in assembling.

Examples and application examples are not limited to the above configurations, and various kinds of modifications and changes may be conceivable without departing from the scope of the present invention.

For example, when the spherical shell diaphragm 201 is formed, using the diaphragm 100 with a regular n-gonal shape as the outer shape, sides may be linked together to form a regular polyhedron almost without gaps, if n is 4 and 5, because the sides are fit in well with one another in terms of the lengths and the directions thereof.

Additionally, since the regular polygon may not be configured if n is equal to 6 or more, there remains a gap between adjacent sides when assembling into when a diaphragm with a shape of a spherical shell. However, these gaps are closed with an flexible linking member to link the side together with one another, and to form a spherical shell diaphragm with a nearly spherical shell shape.

The edge 102, which is a linking member linking the diaphragms 10, 10R, and 100, is bonded to the diaphragms 10, 10R, and 100 with an adhesive agent. However, the diaphragms 10, 10R, and 100 may be bonded to one another through an adhesive agent without using the edge 102. Obviously, the adhesive agent is a linking member in the above case.

Since the central axis O of the diaphragms 10 and 100 as an outer shape and the tube axis Ob (in agreement with the central axis of the driving section 32) are in agreement with one another according to the first and second examples of the present invention as described in detail, the diaphragms 10 and 100 may have a proper and larger projected area with regard to the size of the housing 35 supporting the diaphragms 10 and 100.

Accordingly, a highly efficient electro-acoustic conversion of input signals may be realized, and high sound pressure may be obtained even in a range of low-pitched sounds.

Moreover, since the reference direction of radiated sounds is in agreement with the vibration direction, directivity characteristics which is clear and uniform in the circumferential direction may be obtained.

It should be understood that many modifications and adaptations of the invention will become apparent to those skilled in the art and it is intended to encompass such obvious modifications and changes in the scope of the claims appended hereto.

What is claimed is:

1. A diaphragm, comprising:

an outer shape section with a regular n-gonal shape which is inscribed in a circle with one diameter, where n is an integer of 4 or more; and n number of top portions that are provided respectively within n number of triangles obtained by dividing said regular n-gonal shape with line segments connecting the center of said regular n-gonal shape and the vertices of said regular n-gonal shape, wherein each line segment obtained by connecting said top portions with vertices and said center is formed to be a ridge line;

wherein said n-number of top portions are on an outer periphery line which is rotationally symmetric about an eccentric axis which is eccentric with regard to the central axis of said regular n-gonal shape.

2. The diaphragm according to claim 1, wherein said n-number of top portions and the center of said regular n-gonal shape are positioned so as to protrude in one direction with regard to a plane including said vertices.

3. The diaphragm according to claim 2, wherein the center of and the vertices of said regular n-gonal shape, and said n-number of top portions are on the same spherical surface.

4. An electroacoustic transducer, comprising:

the diaphragm according to claim 1;

a flexible connecting member connected with the outer shape section of said diaphragm;

a frame supporting said diaphragm through said connecting member in such a way that said diaphragm is freely vibrated; and a driving section which has a voice coil bobbin linked to one surface of said inner shape section in said diaphragm, and vibrates said diaphragm.

5. A spherical shell diaphragm, comprising:

a plurality of diaphragms with a regular n-gonal shape which is inscribed in a circle with one diameter, where n is an integer of 4 or more, said plurality of diaphragms being formed into a nearly spherical shape by linking together outer shape sections of said plurality of diaphragms, wherein each of said plurality of diaphragms includes;

n number of top portions that are provided respectively within n number of triangles obtained by dividing said regular n-gonal shape with line segments connecting the center of said regular n-gonal shape and the vertices of said regular n-gonal shape, wherein each line segment obtained by connecting said top portions with vertices and said center is formed to be a ridge line;

wherein said n-number of top portions are on an outer periphery line of a shape rotationally symmetric about the central axis of said regular n-gonal shape.

6. The spherical shell diaphragm according to claim 5, wherein said rotationally symmetric shape is rotationally symmetric about an eccentric axis which is eccentric with regard to said central axis.

7. The spherical shell diaphragm according to claim 5, wherein in said diaphragms, said n-number of top portions and the center of said regular n-gonal shape are positioned so as to protrude in one direction with regard to a plane including said vertices.

8. The spherical shell diaphragm according to claim 7, wherein in each of said diaphragms, n-number of vertices as vertices of said regular n-gonal shape in said outer shape section, said n-number of top portions, and the center of said regular n-gonal shape are on the same spherical surface.

9. The spherical shell diaphragm according to claim 8, wherein said spherical shell diaphragm include a plurality of diaphragms with the same spherical surface as one another.

10. The spherical shell diaphragm according to claim 5, wherein the outer shape sections of said plurality of diaphragms are connected with one another through flexible linking members.

11. The spherical shell diaphragm according to claim 5, wherein said nearly spherical shell shape is a regular dodecahedron.

12. The spherical shell diaphragm according to claim 5, wherein when there is set a dividing line separates said spherical shell diaphragm into two portions along said outer shape sections in such a way that each of said two portions has the same number of said diaphragms having an outer shape section along said dividing line, said eccentric axis of said diaphragm having an outer shape section along the dividing line is eccentric in a direction toward the vertex of said outer shape section along said dividing line.

13. The spherical shell diaphragm according to claim 5, wherein any one of said plurality of diaphragms has an opening.

14. An electroacoustic transducer using the spherical shell diaphragm according to claim 5.

15. The electroacoustic transducer according to claim 14, comprising:

a plurality of voice coil bobbins connected respectively with the inside surfaces of said plurality of diaphragms; and a plurality of driving sections which respectively include one of said voice coil bobbins, and vibrate said plurality of diaphragms, respectively.

16. An electroacoustic transducer using the spherical shell diaphragm according to claim 11, wherein said plurality of diaphragms are linked together in such a way that said plurality of diaphragms form eleven surfaces of said regular dodecahedron.

17. The electroacoustic transducer according to claim 16, comprising:

a plurality of voice coil bobbins connected respectively with the inside surfaces of said plurality of diaphragms; and a plurality of driving sections which respectively include one of said voice coil bobbin, and vibrate said plurality of diaphragms, respectively.

18. A method of manufacturing an electroacoustic transducer, comprising:

forming, from a diaphragm material, a plurality of diaphragm segments with an outer shape section having a shape of a regular pentagon such that the regular pentagon is inscribed in a circle with one diameter;

arranging the plurality of diaphragm segments on a plane to, in turn, bond a side of one of the plurality of said diaphragm segments and a side of another one of the plurality of said diaphragm together on the plane through a flexible linking member by positioning both vertices of the side of the one and both vertices of the side of the another one;

fastening a plurality of driving sections which respectively have a voice coil bobbin, and vibrating said plurality of diaphragm segments, respectively, to each surface of a base with an outer shape of a regular dodecahedron in such a way that each of said voice coil bobbins extends in a direction intersecting perpendicularly to each of said surfaces of said regular dodecahedron; and fastening said plurality of voice coil bobbins to the inside surfaces of said plurality of diaphragm segments, respectively, wherein said plurality of diaphragm segments comprise:

an inner shape section which protrudes in one direction with regard to a plane including said outer shape section, wherein a shape formed by projecting said inner shape section on said plane is rotationally symmetric about the central axis of said circle with the one diameter; and a vibrating face section that links said outer shape section and said inner shape section and has an inclined face inclined to said central axis, wherein any one of cross-sectional shapes of said vibrating face section is rotationally symmetric about an eccentric axis which is eccentric with regard to said central axis, said cross-sectional shapes being defined by a plane intersecting perpendicularly to said central axis.

19. The A method of manufacturing an electroacoustic transducer, comprising:

forming, from a diaphragm material, a plurality of diaphragm segments with an outer shape section having a shape of a regular pentagon such that the regular pentagon is inscribed in a circle with one diameter;

arranging the plurality of diaphragm segments on a plane to, in turn, bond a side of one of the plurality of said diaphragm segments and a side of another one of the plurality of said diaphragm together on the plane through a flexible linking member by positioning both vertices of the side of the one and both vertices of the side of the another one;

fastening a plurality of driving sections which respectively have a voice coil bobbin, and vibrate said plurality of diaphragm segments, respectively, to each surface of a base with an outer shape of a regular dodecahedron in such a way that each of said voice coil bobbins extends in a direction intersecting perpendicularly to each of said surfaces of said regular dodecahedron; and fastening said plurality of voice coil bobbins to the inside surfaces of said plurality of diaphragm segments, respectively, wherein each of said plurality of diaphragm segments comprises:

an outer shape section with a regular n-gonal shape which is inscribed in a circle with one diameter, where n is an integer of 4 or more;

n number of top portions that are provided respectively within n number of triangles obtained by dividing said regular n-gonal shape with line segments connecting the center of said regular n-gonal shape and the vertices of said regular n-gonal shape, wherein each line segment obtained by connecting said top portions with vertices and said center is formed to be a ridge line; and said n-number of top portions are on an outer periphery line of a shape with rotational symmetry about an eccentric axis which is eccentric with regard to the central axis of said regular n-gonal shape.

* * * * *

UNITED STATES PATENT AND TRADEMARK OFFICE

CERTIFICATE OF CORRECTION

PATENT NO. : 7,743,879 B2
APPLICATION NO. : 12/232206
DATED : June 29, 2010
INVENTOR(S) : Kazuyuki Inagaki et al.

It is certified that error appears in the above-identified patent and that said Letters Patent is hereby corrected as shown below:

Column 30, Claim 19, Line 46
Please delete "The"

Signed and Sealed this

Seventeenth Day of August, 2010

David J. Kappos

David J. Kappos
*Director of the United States Patent and Trademark Office*